US010337430B2

(12) United States Patent
Jammoussi et al.

(10) Patent No.: US 10,337,430 B2
(45) Date of Patent: Jul. 2, 2019

(54) METHOD AND SYSTEM FOR DETERMINING AIR-FUEL RATIO IMBALANCE

(71) Applicant: Ford Global Technologies, LLC, Dearborn, MI (US)

(72) Inventors: Hassene Jammoussi, Canton, MI (US); Imad Hassan Makki, Dearborn Heights, MI (US); Michael Igor Kluzner, West Bloomfield, MI (US); Gopichandra Surnilla, West Bloomfield, MI (US); Robert Roy Jentz, Westland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 154 days.

(21) Appl. No.: 15/182,518

(22) Filed: Jun. 14, 2016

(65) Prior Publication Data

US 2017/0356363 A1 Dec. 14, 2017

(51) Int. Cl.

| | |
|---|---|
| ***F02D 41/00*** | (2006.01) |
| ***F02D 41/04*** | (2006.01) |
| ***F02D 41/14*** | (2006.01) |
| ***F02D 41/26*** | (2006.01) |
| ***F02D 41/12*** | (2006.01) |

(Continued)

(52) U.S. Cl.

CPC ..... *F02D 41/0087* (2013.01); *F02D 41/0085* (2013.01); *F02D 41/042* (2013.01); *F02D 41/123* (2013.01); *F02D 41/1444* (2013.01); *F02D 41/1454* (2013.01); *F02D 41/222* (2013.01); *F02D 41/2438* (2013.01); *F02D 41/2454* (2013.01); *F02D 41/2474* (2013.01); *F02D 41/26* (2013.01)

(58) Field of Classification Search

CPC ..... F02D 41/0087; F02D 41/1454; F02D 41/2454; F02D 41/2438; F02D 41/222; F02D 41/2474; F02D 41/123; F02D 41/0085; F02D 41/26; F02D 41/1444; F02D 41/042

See application file for complete search history.

(56) References Cited

U.S. PATENT DOCUMENTS 4,739,614 A * 4/1988 Katsuno ..... F01N 11/007 123/688

6,102,018 A 8/2000 Kerns et al.

(Continued)

OTHER PUBLICATIONS

Jammoussi, Hassene et al., "Method and System for Determining Air-Fuel Ratio Imbalance," U.S. Appl. No. 14/641,073, filed Mar. 6, 2015, 64 pages.

(Continued)

*Primary Examiner* — David Hamaoui

(74) *Attorney, Agent, or Firm* — Julia Voutyras; McCoy Russell LLP

(57) ABSTRACT

Methods and systems include determining a cylinder air-fuel ratio imbalance in a multi-cylinder engine. In one example, the method may include sequentially firing an engine cylinder to provide an expected air-fuel deviation and learning cylinder air-fuel ratio imbalance based on an error between an actual air-fuel ratio deviation from a maximum lean air-fuel ratio relative to an expected air-fuel deviation during a deceleration fuel shut-off event.

9 Claims, 10 Drawing Sheets

(51) Int. Cl.
*F02D 41/22* (2006.01)
*F02D 41/24* (2006.01)

(56) References Cited

U.S. PATENT DOCUMENTS 6,324,836 B1 12/2001 Nakagawa et al.
6,550,466 B1 4/2003 Behr et al.
7,000,379 B2 2/2006 Makki et al.
7,497,210 B2 * 3/2009 Okamoto ..... F02D 13/06 123/673
7,802,563 B2 9/2010 Behr et al.
8,261,727 B2 9/2012 Bagnasco et al.
8,302,581 B2 * 11/2012 Nishikiori ..... F02D 41/0082 123/434
8,589,055 B2 * 11/2013 Hakariya ..... F02D 41/0085 123/481
9,657,674 B2 * 5/2017 Jammoussi ..... F02D 41/1475
9,683,506 B2 * 6/2017 Jammoussi ..... F02D 41/123
9,759,148 B2 * 9/2017 Jammoussi ..... F02D 41/1497
2002/0038544 A1 * 4/2002 Ikemoto ..... F02D 41/123 60/285
2004/0006973 A1 1/2004 Makki et al.
2013/0184969 A1 7/2013 Rollinger et al.
2014/0163841 A1 * 6/2014 Sane ..... F02D 41/0087 701/104
2014/0277998 A1 9/2014 Martin et al.
2014/0290622 A1 10/2014 Ikeda et al.
2016/0018291 A1 1/2016 Uhrich et al.
2016/0290266 A1 * 10/2016 Miyamoto ..... F02D 41/123
2017/0350332 A1 * 12/2017 Martin ..... F02D 41/0087
2017/0356380 A1 * 12/2017 Surnilla ..... F02D 17/02

OTHER PUBLICATIONS

Jammoussi, Hassene et al., "Method and System for Determining Air-Fuel Ratio Imbalance," U.S. Appl. No. 14/641,124, filed Mar. 6, 2015, 66 pages.
Jammoussi, Hassene et al., "Method and System for Determining Air-Fuel Ration Imbalance via Engine Torque," U.S. Appl. No. 14/712,202, filed May 14, 2015, 57 pages.
Surnilla, Gopichandra et al., "Method and System for Air-Fuel Ratio Imbalance," U.S. Appl. No. 15/182,491, filed Jun. 14, 2016, 84 pages.

* cited by examiner

METHOD AND SYSTEM FOR DETERMINING AIR-FUEL RATIO IMBALANCE

FIELD

The present description relates generally to methods and systems for controlling a vehicle engine to monitor an air-fuel ratio imbalance during decelerated fuel shut-off (DFSO).

BACKGROUND/SUMMARY

Engine air-fuel ratio can be controlled to provide improved catalyst performance, reduce emissions and improve engine fuel efficiency. Specifically, systems to control air-fuel ratio in engine cylinders may include monitoring of exhaust gas oxygen concentration at an exhaust gas sensor and adjusting fuel and/or charge air parameters to reduce air-fuel ratio variation, minimize degradation of exhaust catalyst and improve engine performance.

An example of an engine air-fuel ratio control system and method is provided by Makki et al in U.S. Pat. No. 7,000,379. Therein an inner feedback control loop is used to control engine air-fuel ratio based on input from a first exhaust sensor coupled upstream of an exhaust catalyst, and an outer feedback control loop is used to modify the air-fuel ratio provided to the inner feedback control loop to maintain the output of a second exhaust sensor (coupled on the exhaust catalyst) within a predetermined range of a desired reference value. The catalyst model determines changes in catalyst dynamics based on input from the second exhaust sensor.

However, when using such an engine air-fuel ratio control system, factors such as the geometry of the exhaust system, and a location and sensitivity of the exhaust gas sensors may create discrepancies in a measured air-fuel ratio. For example, an exhaust gas sensor coupled upstream of an engine exhaust system receiving exhaust from multiple cylinders may bias sensor readings toward output of cylinders close to the exhaust gas sensor more than output from cylinders afar. Consequently, it may be difficult to determine cylinder to cylinder air-fuel ratio imbalance in engines with multiple cylinders. Further, poor exhaust mixing at the exhaust gas sensor may create further discrepancies in the measured air-fuel ratio and make it difficult to correct cylinder air-fuel ratio imbalance.

In other engine systems, cylinder air-fuel ratio imbalance can be monitored using methods based on crankshaft acceleration. However, transient changes in torque demand (such as from various engine accessory loads) and purge errors may affect the learning of cylinder air-fuel ratio imbalance.

In view of the above, the inventors herein have developed a method for determining air-fuel ratio imbalance among cylinder groups. In one example, a method comprises: during a deceleration fuel shut-off (DFSO), sequentially firing cylinders of a cylinder group, each cylinder fueled with a fuel pulse width selected to provide an expected air-fuel deviation; and indicating an air-fuel ratio variation for each cylinder based on an error between an actual air-fuel deviation from a maximum lean air-fuel ratio during the DFSO relative to the expected air-fuel deviation. In one example, the learning may be performed based on the air-fuel deviation estimated at a heated exhaust gas sensor. In this way, learning an air-fuel ratio imbalance in each engine cylinder may be improved while minimizing issues related to sensor sensitivity and exhaust mixing.

For example, responsive to a first rich air-fuel variation in a cylinder (wherein an actual air-fuel ratio is richer than an expected air-fuel ratio), a controller may learn a first air-fuel error and during subsequent operation, the fueling of the cylinder may be enleaned as a function of the first air-fuel error. Likewise, responsive to a second lean air-fuel variation in a cylinder (wherein an actual air-fuel ratio is leaner than an expected air-fuel ratio), the controller may learn a second air-fuel error and during subsequent operation, the fueling of the cylinder may be enriched as a function of the second air-fuel error. By determining cylinder air-fuel imbalance based on air-fuel variation and adjusting fueling in a cylinder based on the air-fuel error, cylinder air-fuel ratio variations may be reduced while minimizing issues related to sensor sensitivity and exhaust mixing.

The approach described here may confer several advantages. For example, the air-fuel ratio error is learned when a single cylinder in each cylinder bank of an engine is firing while the remaining cylinders are deactivated, allowing better detection of air-fuel ratio imbalance among cylinder groups. Consequently, the approach ensures reduced emissions and improved fuel efficiency. Furthermore, by learning cylinder air-fuel ratio imbalance based on sensor readings at a downstream exhaust gas sensor, issues related to sensor location and sensitivity may be further reduced while minimizing error due to poor exhaust mixing.

The above discussion includes recognitions made by the inventors and not admitted to be generally known. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
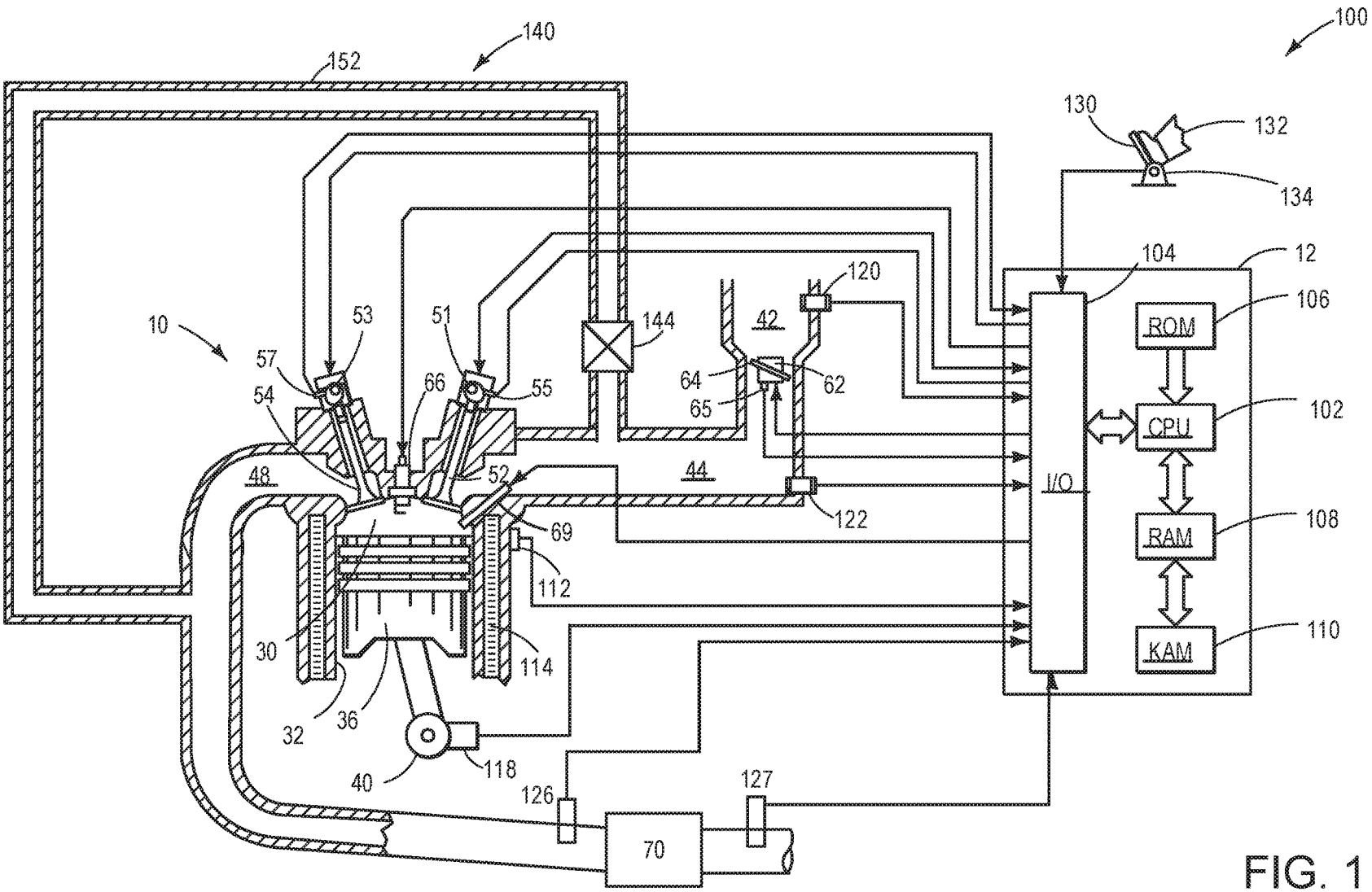
FIG. 1 represents an engine with a cylinder.
Figure 2:
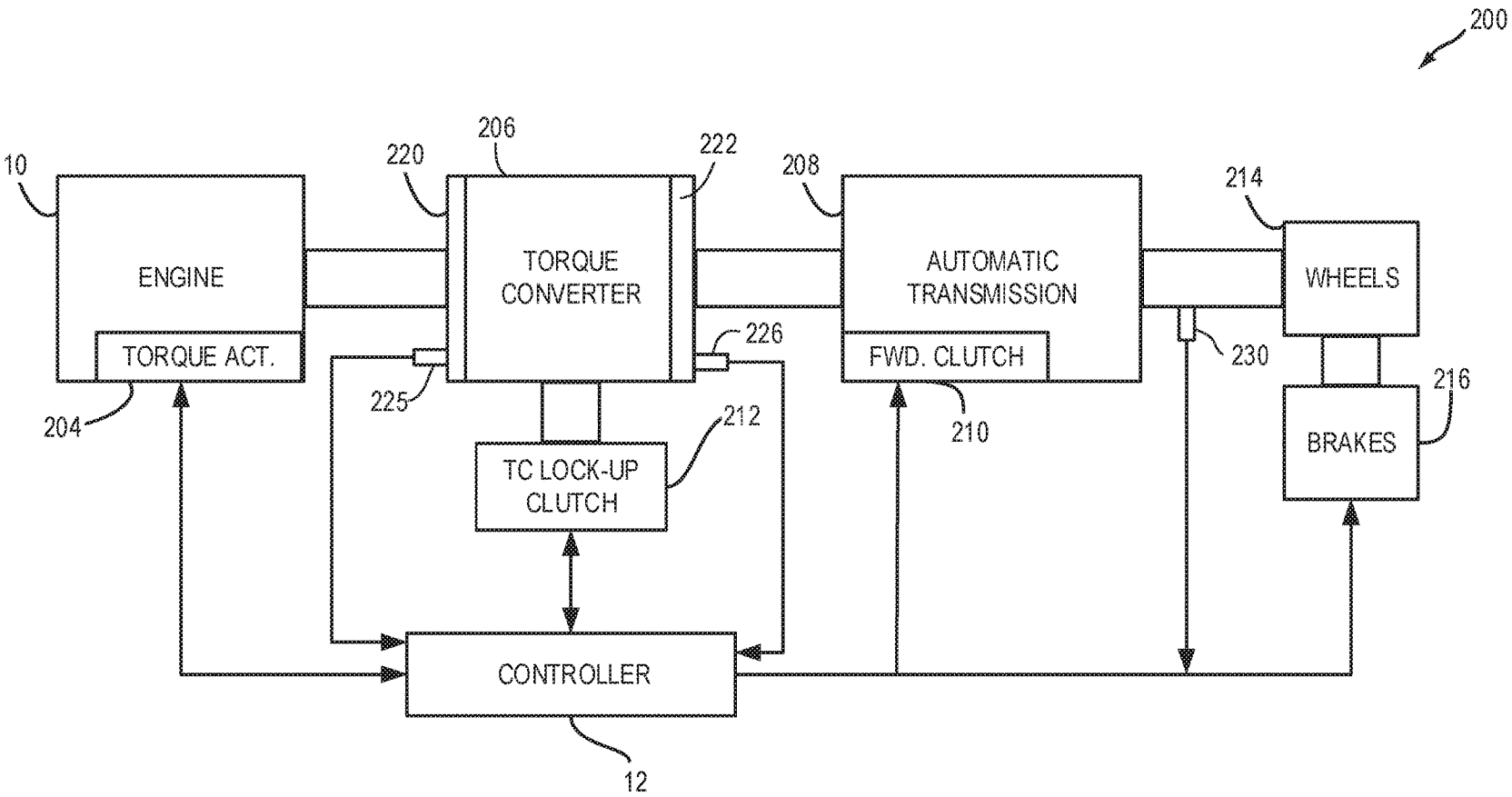
FIG. 2 represents an engine with a transmission and various components.
Figure 3:
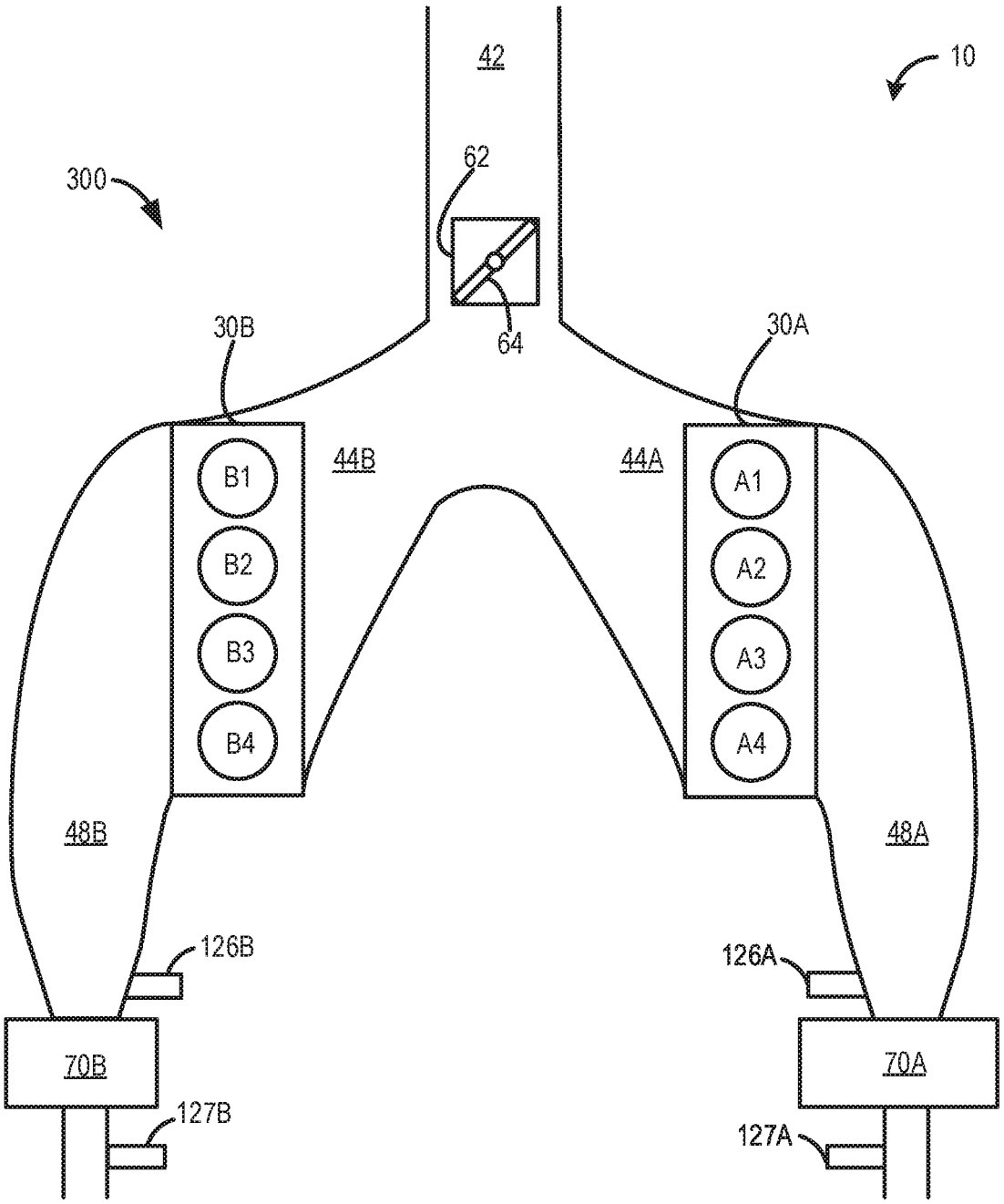
FIG. 3 represents a V-8 engine with two cylinder banks.
Figure 4:
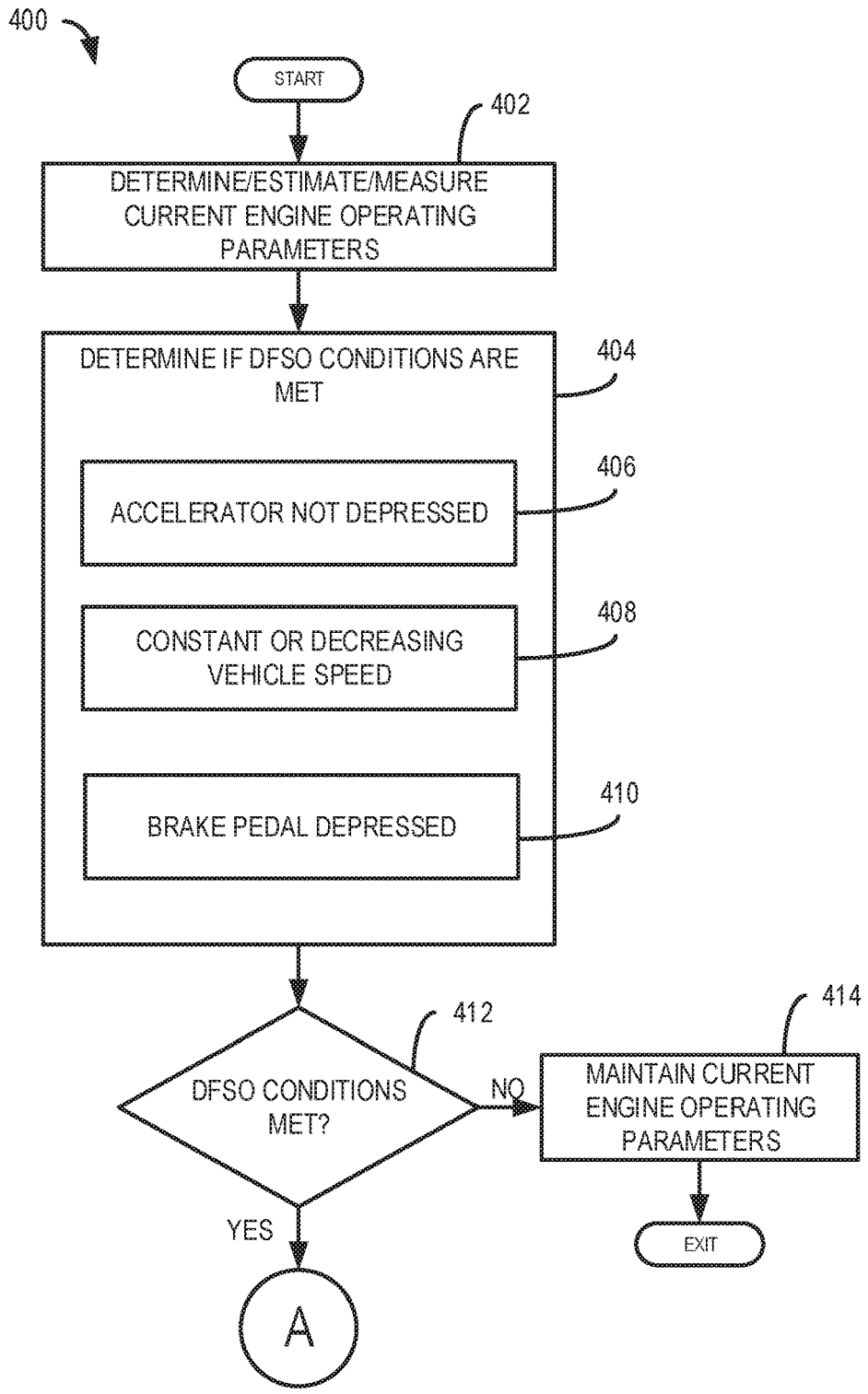
FIG. 4 represents a method for determining conditions for DFSO.
Figure 5:
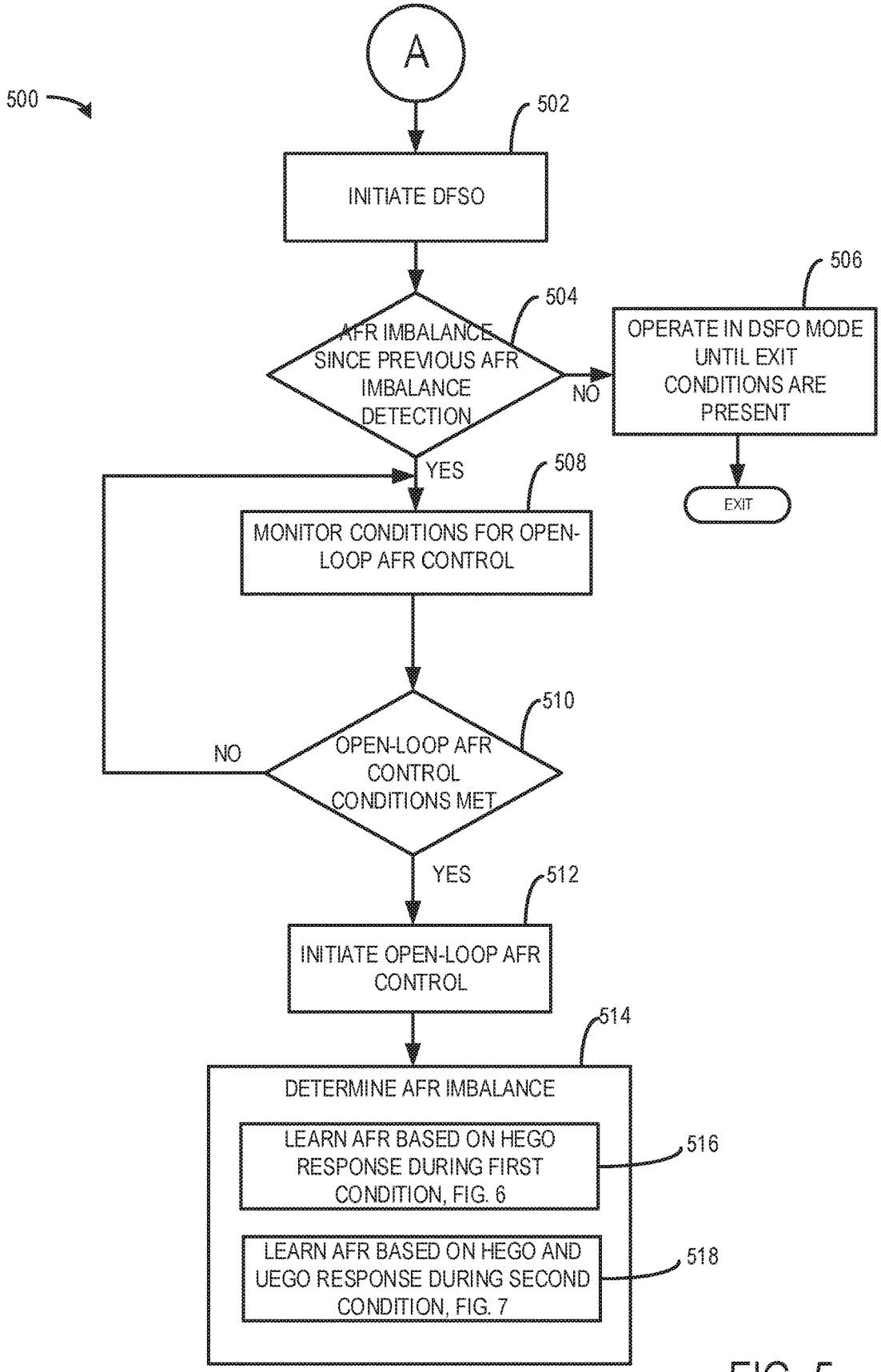
FIG. 5 represents a method for determining conditions and initiation of open-loop air-fuel ratio control.
Figure 6:
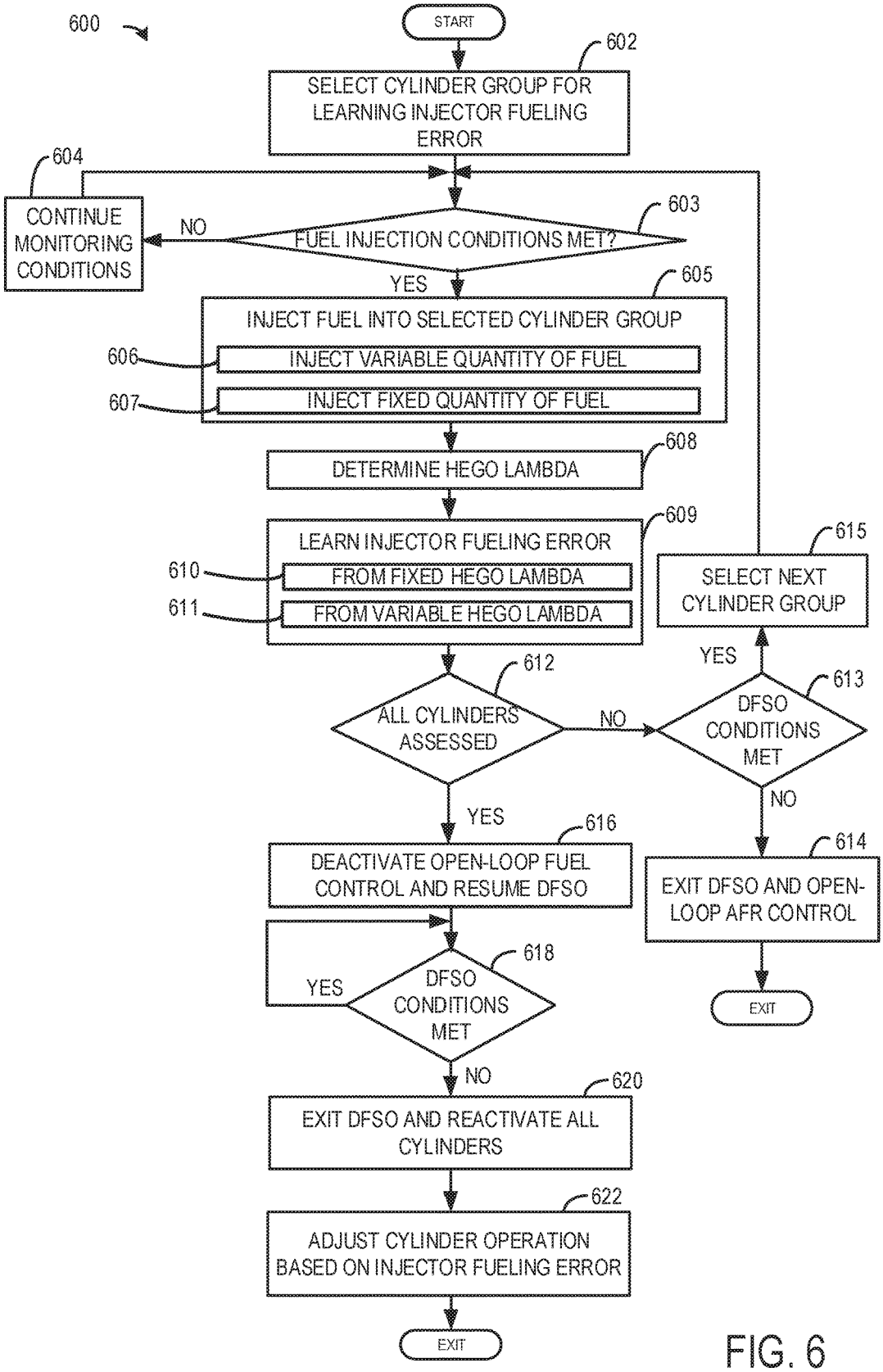
FIG. 6 represents a method for firing selected cylinder groups during open-loop air-fuel ratio control and learning cylinder air-fuel imbalance based on a HEGO sensor response.
Figure 7:
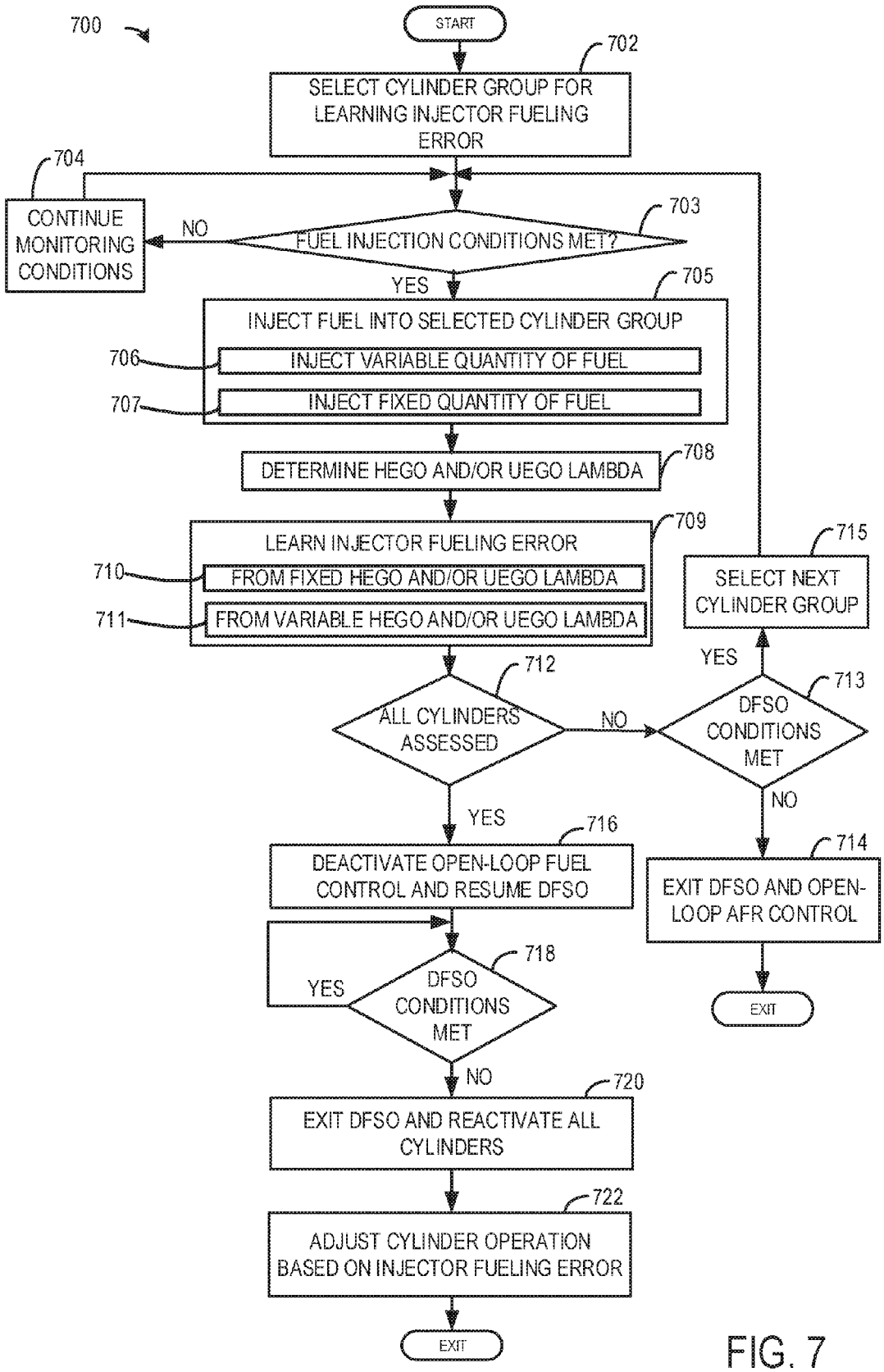
FIG. 7 represents a method for firing selected cylinder groups during open-loop air-fuel ratio control and learning cylinder air-fuel imbalance based on a HEGO and/or UEGO sensor response.
Figure 8:
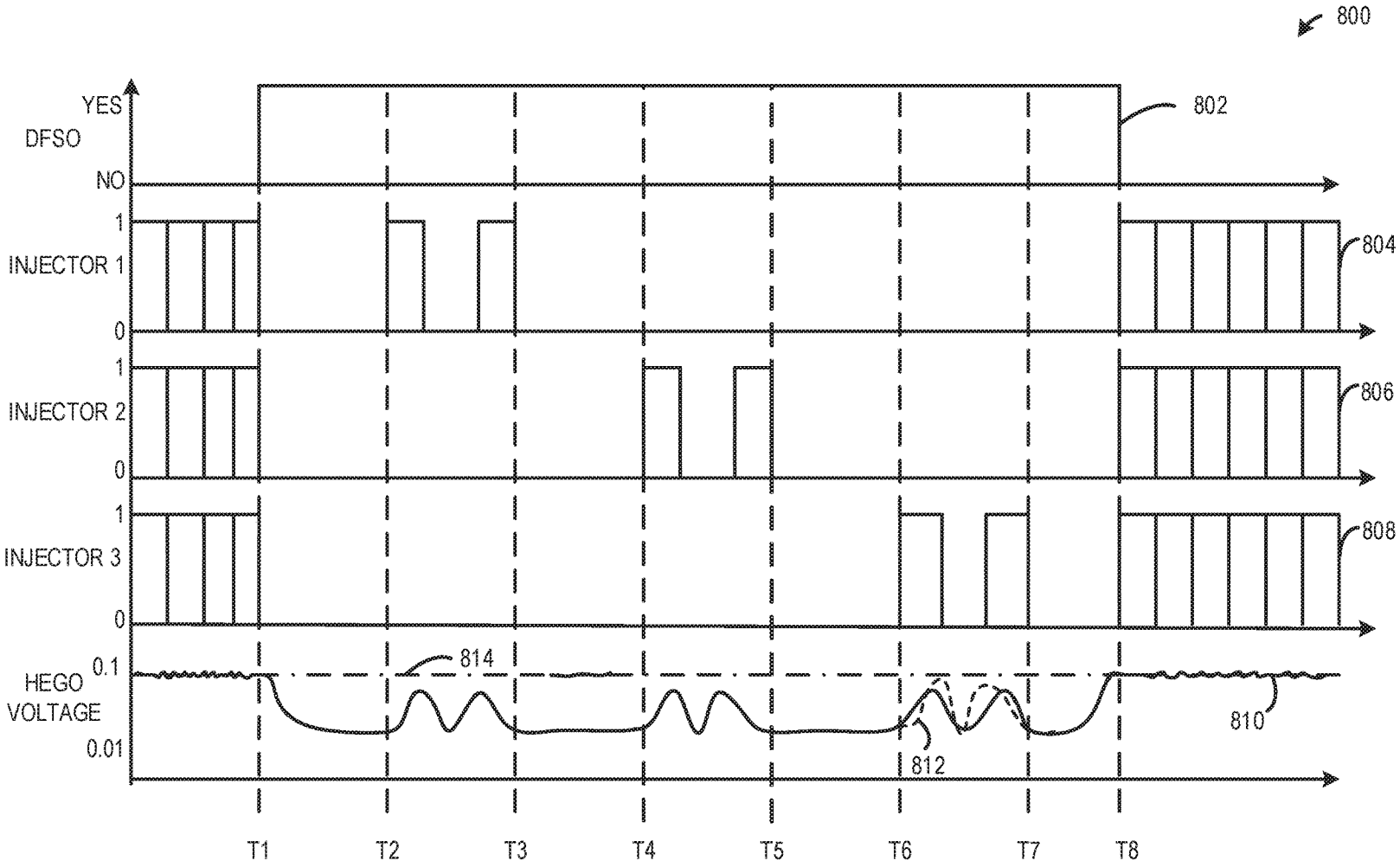
FIG. 8 represents a graphical data measured open-loop air-fuel ratio control to determine air-fuel ratio imbalance based on a HEGO sensor response.
Figure 9:
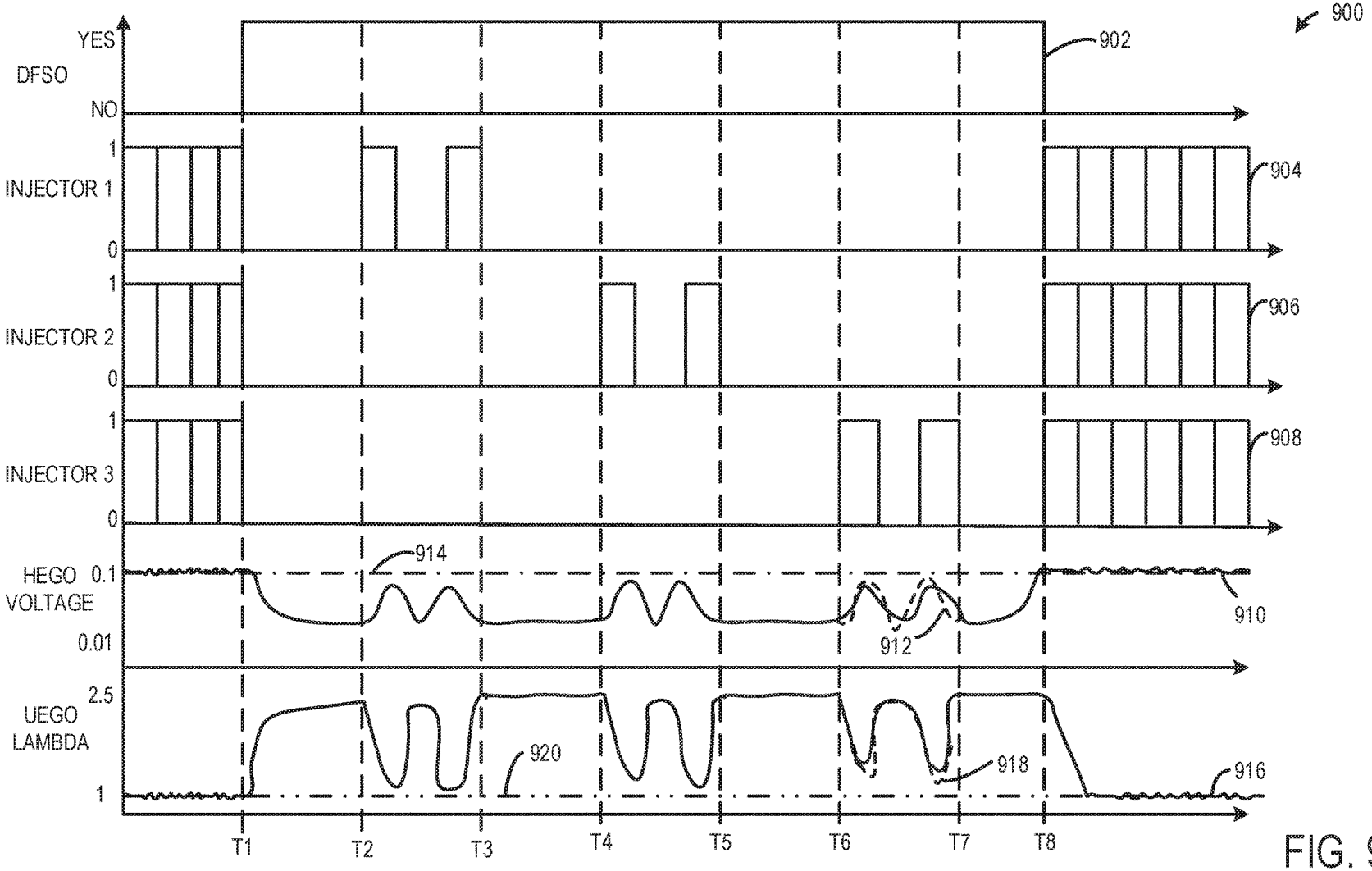
FIG. 9 represents a graphical data measured open-loop air-fuel ratio control to determine air-fuel ratio imbalance based on a UEGO and HEGO sensor response.
Figure 10:
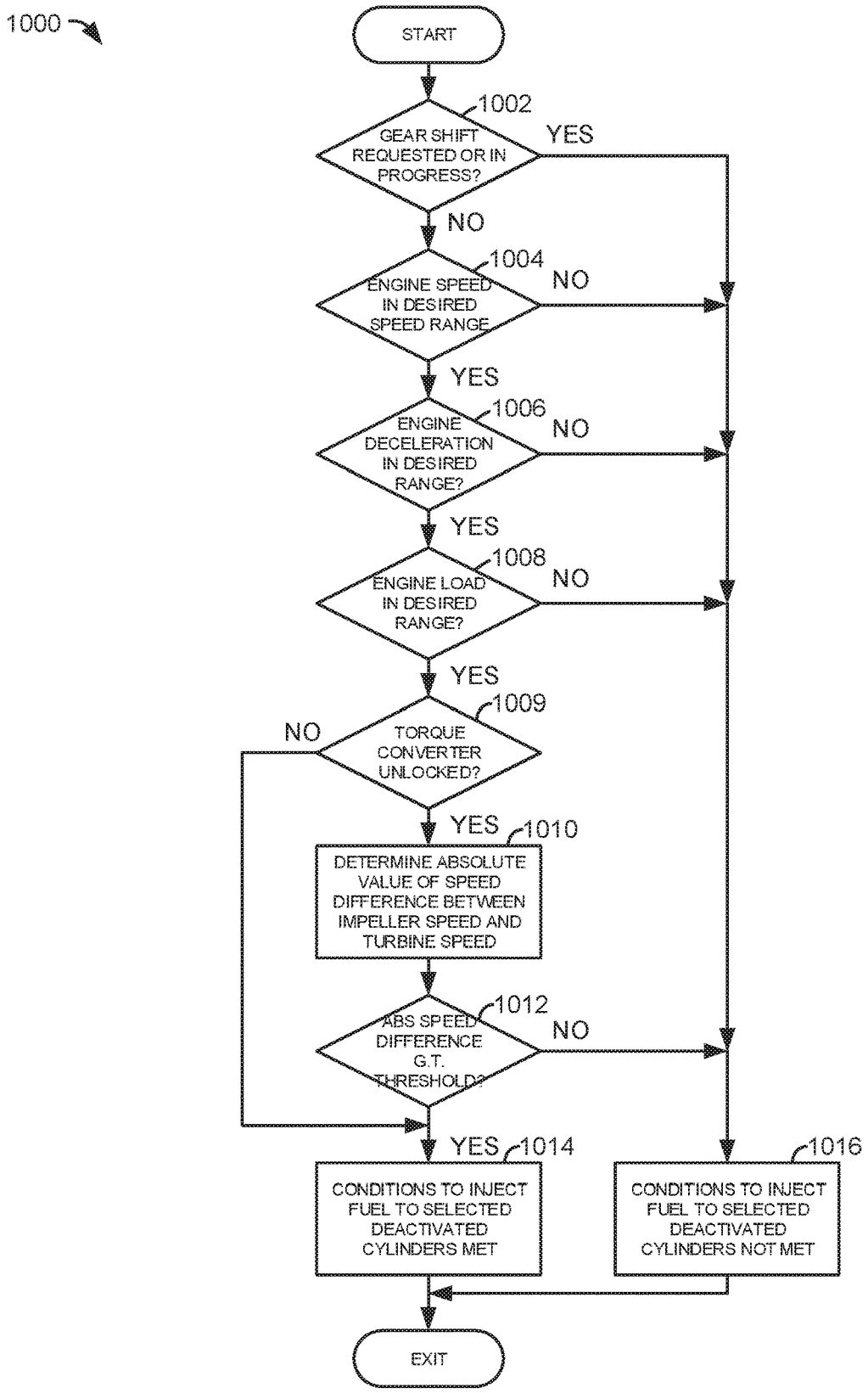
FIG. 10 is a flowchart of a method for determining if fuel injection is to be activated in selected cylinders to determine cylinder air-fuel ratio imbalance.

The following description relates to systems and methods for detecting an air-fuel ratio imbalance (e.g., variations between air-fuel ratios of engine cylinders) during DFSO. FIG. 1 illustrates a single cylinder of an engine comprising an exhaust gas sensor upstream of an emission control device. FIG. 2 depicts an engine, transmission, and other vehicle components. FIG. 3 depicts a V-8 engine with two cylinder banks, two exhaust manifolds, and two exhaust gas sensors. FIG. 4 relates to a method for determining conditions for DFSO. FIG. 5 illustrates a method for initiating open-loop air-fuel ratio control during DFSO. FIG. 6 illustrates an exemplary method for carrying out the open-loop air-fuel ratio control and learning cylinder air-fuel imbalance based on a HEGO sensor response. FIG. 7 illustrates an exemplary method for carrying out the open-loop air-fuel ratio control and learning cylinder air-fuel imbalance based on a HEGO and/or UEGO sensor response. FIG. 8 represents a graphical data measured open-loop air-fuel ratio control to determine air-fuel ratio imbalance based on a HEGO sensor response. FIG. 9 represents a graphical data measured open-loop air-fuel ratio control to determine air-fuel ratio imbalance based on a HEGO and/or UEGO sensor response. Finally, FIG. 10 shows a method for determining if fuel injection is to be activated in selected cylinders to determine cylinder air-fuel ratio imbalance.

Continuing to FIG. 1, a schematic diagram showing one cylinder of a multi-cylinder engine 10 in an engine system 100, which may be included in a propulsion system of an automobile, is shown. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 10 may include a cylinder formed by cylinder walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 10.

An exhaust gas sensor 126 is shown coupled to the exhaust passage 48 upstream of an emission control device 70 according to a direction of exhaust flow. Further, another exhaust gas sensor 127 is shown coupled to the exhaust passage 48 downstream of an emission control device 70 according to a direction of exhaust flow. The sensors 126 and 127 may be any suitable sensor for providing an indication of exhaust gas air-fuel ratio such as a linear oxygen sensor or a universal or wide-range exhaust gas oxygen (UEGO), a two-state oxygen sensor or EGO, a heated exhaust gas oxygen (HEGO). In one example, upstream exhaust gas sensor 126 is a UEGO sensor and 127 is a HEGO sensor, both exhaust gas sensors configured to provide output, such as a voltage signal, that is proportional to the amount of oxygen present in the exhaust. Controller 12 converts oxygen sensor output into exhaust gas air-fuel ratio via an oxygen sensor transfer function.

In another example, UEGO sensor 126 coupled upstream of the catalyst is configured to identify air-fuel imbalances that will result in inaccurate burning of fuel at a face of a first brick of the catalyst. The HEGO sensor 127 coupled downstream of the catalyst is configured to infer air-fuel imbalances that result from inaccurate burning of fuel at the face of a second brick of the catalyst. As such, the exhaust gas received at the HEGO sensor tends to be hotter than the exhaust gas received at the UEGO sensor.

The emission control device 70 is shown arranged along the exhaust passage 48 downstream of the exhaust gas sensor 126 and upstream of the exhaust gas sensor 127. The device 70 may be a three way catalyst (TWC), $NO_x$ trap, various other emission control devices, or combinations thereof. In some examples, during operation of the engine 10, the emission control device 70 may be periodically reset by operating at least one cylinder of the engine within a particular air-fuel ratio.

An exhaust gas recirculation (EGR) system 140 may route a desired portion of exhaust gas from the exhaust passage 48 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes.

The controller 12 is shown in FIG. 1 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of crankshaft 40; throttle position from a throttle position sensor 65; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 66, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 1 shows only one cylinder of a multi-cylinder engine, and each cylinder may similarly include its own set of intake/exhaust valves, fuel injector, spark plug, etc.

As will be appreciated by someone skilled in the art, the specific routines described below in the flowcharts may represent one or more of any number of processing strategies such as event driven, interrupt-driven, multi-tasking, multi-threading, and the like. As such, various acts or functions illustrated may be performed in the sequence illustrated, in parallel, or in some cases omitted. Like, the order of processing is not necessarily required to achieve the features and advantages, but is provided for ease of illustration and description. Although not explicitly illustrated, one or more of the illustrated acts or functions may be repeatedly performed depending on the particular strategy being used. Further, these Figures graphically represent code to be programmed into the computer readable storage medium in controller 12 to be carried out by the controller in combination with the engine hardware, as illustrated in FIG. 1.

FIG. 2 is a block diagram of a vehicle drive-train 200. Drive-train 200 may be powered by engine 10. In one example, engine 10 may be a gasoline engine. In alternate examples, other engine configurations may be employed, for example, a diesel engine. Engine 10 may be started with an engine starting system (not shown). Further, engine 10 may generate or adjust torque via torque actuator 204, such as a fuel injector, throttle, etc.

An engine output torque may be transmitted to torque converter 206 to drive an automatic transmission 208 by engaging one or more clutches, including forward clutch 210, where the torque converter may be referred to as a component of the transmission. Torque converter 206 includes an impeller 220 that transmits torque to turbine 222 via hydraulic fluid. One or more clutches may be engaged to change mechanical advantage between the engine vehicle wheels 214. Impeller speed may be determined via speed sensor 225, and turbine speed may be determined from speed sensor 226 or from vehicle speed sensor 230. The output of the torque converter may in turn be controlled by torque converter lock-up clutch 212. As such, when torque converter lock-up clutch 212 is fully disengaged, torque converter 206 transmits torque to automatic transmission 208 via fluid transfer between the torque converter turbine and torque converter impeller, thereby enabling torque multiplication. In contrast, when torque converter lock-up clutch 212 is fully engaged, the engine output torque is directly transferred via the torque converter clutch to an input shaft (not shown) of transmission 208. Alternatively, the torque converter lock-up clutch 212 may be partially engaged, thereby enabling the amount of torque relayed to the transmission to be adjusted. A controller 12 may be configured to adjust the amount of torque transmitted by the torque converter by adjusting the torque converter lock-up clutch in response to various engine operating conditions, or based on a driver-based engine operation request.

Torque output from the automatic transmission 208 may in turn be relayed to wheels 214 to propel the vehicle. Specifically, automatic transmission 208 may adjust an input driving torque at the input shaft (not shown) responsive to a vehicle traveling condition before transmitting an output driving torque to the wheels.

Further, wheels 214 may be locked by engaging wheel brakes 216. In one example, wheel brakes 216 may be engaged in response to the driver pressing his foot on a brake pedal (not shown). In the similar way, wheels 214 may be unlocked by disengaging wheel brakes 216 in response to the driver releasing his foot from the brake pedal.

A mechanical oil pump (not shown) may be in fluid communication with automatic transmission 208 to provide hydraulic pressure to engage various clutches, such as forward clutch 210 and/or torque converter lock-up clutch 212. The mechanical oil pump may be operated in accordance with torque converter 206, and may be driven by the rotation of the engine or transmission input shaft, for example. Thus, the hydraulic pressure generated in mechanical oil pump may increase as an engine speed increases, and may decrease as an engine speed decreases.

FIG. 3 shows an example version of engine 10 that includes multiple cylinders arranged in a V configuration. In this example, engine 10 is configured as a variable displacement engine (VDE). Engine 10 includes a plurality of combustion chambers or cylinders 30. The plurality of cylinders 30 of engine 10 are arranged as groups of cylinders on distinct engine banks. In the depicted example, engine 10 includes two engine cylinder banks 30A, 30B. Thus, the cylinders are arranged as a first group of cylinders (four cylinders in the depicted example) arranged on first engine bank 30A and label A1-A4, and a second group of cylinders (four cylinders in the depicted example) arranged on second engine bank 30B labeled B1-B4. It will be appreciated that while the example depicted in FIG. 1 shows a V-engine with cylinders arranged on different banks, this is not meant to be limiting, and in alternate examples, the engine may be an in-line engine with all engine cylinders on a common engine bank.

Engine 10 can receive intake air via an intake passage 42 communicating with branched intake manifold 44A, 44B. Specifically, first engine bank 30A receives intake air from intake passage 42 via a first intake manifold 44A while second engine bank 30B receives intake air from intake passage 42 via second intake manifold 44B. While engine banks 30A, 30B are shown with a common intake manifold, it will be appreciated that in alternate examples, the engine may include two separate intake manifolds. The amount of air supplied to the cylinders of the engine can be controlled by adjusting a position of throttle 62 on throttle plate 64. Additionally, an amount of air supplied to each group of cylinders on the specific banks can be adjusted by varying an intake valve timing of one or more intake valves coupled to the cylinders.

Combustion products generated at the cylinders of first engine bank 30A are directed to one or more exhaust catalysts in first exhaust manifold 48A where the combustion products are treated before being vented to the atmosphere. A first emission control device 70A is coupled to first exhaust manifold 48A. First emission control device 70A may include one or more exhaust catalysts, such as a close-coupled catalyst. In one example, the close-coupled catalyst at emission control device 70A may be a three-way catalyst. Exhaust gas generated at first engine bank 30A is treated at emission control device 70A Combustion products generated at the cylinders of second engine bank 30B are exhausted to the atmosphere via second exhaust manifold 48B. A second emission control device 70B is coupled to second exhaust manifold 48B. Second emission control device 70B may include one or more exhaust catalysts, such as a close-coupled catalyst. In one example, the close-coupled catalyst at emission control device 70A may be a three-way catalyst. Exhaust gas generated at second engine bank 30B is treated at emission control device 70B.

As described above, a geometry of an exhaust manifold may affect an exhaust gas sensor measurement of an air-fuel ratio of a cylinder during nominal engine operation. During nominal engine operation (e.g., all engine cylinder operating at stoichiometry), the geometry of the exhaust manifold may allow the air-fuel ratio of certain cylinders of an engine bank to be read more predominantly when compared to other cylinders of the same bank, thus reducing a sensitivity of the exhaust gas sensor to detect an air-fuel ratio imbalance of an individual sensor. For example, engine bank 30A comprises four cylinders A1, A2, A3, and A4. During nominal engine operation, exhaust gas from A1 may flow toward a side of the exhaust manifold nearest an upstream exhaust gas sensor 126A and therefore, provide a strong, accurate exhaust sensor readings. However, during nominal engine operation, exhaust gas from A1 may flow toward a side of the exhaust manifold nearest a downstream exhaust gas sensor 127A and therefore, provide another strong, accurate exhaust sensor reading. In this way, an air-fuel ratio imbalance in a cylinder group may be learned with improved accuracy during nominal engine operation. Further, in order to minimize a problem of identifying air-fuel ratio imbalance among multiple cylinders, it may be preferred to deactivate all but one cylinder of an engine bank and to measure the air-fuel ratio of the activated cylinder.

While FIG. 3 shows each engine bank coupled to respective underbody emission control devices, in alternate examples, each engine bank may be coupled to respective emission control devices 70A, 70B but to a common underbody emission control device positioned downstream in a common exhaust passageway.

Various sensors may be coupled to engine 300. For example, a first exhaust gas sensor 126A may be coupled to the first exhaust manifold 48A of first engine bank 30A, upstream of first emission control device 70A while a second exhaust gas sensor 126B is coupled to the second exhaust manifold 48B of second engine bank 30B, upstream of second emission control device 70B. In further examples, a first exhaust gas sensor 127A may be couple to first exhaust manifold 48A of first engine bank 30A, downstream of first emission control device 70A while a second exhaust gas sensor 127B is coupled to the second exhaust manifold 48B of second engine bank 30B, downstream of the second emission control device 70B. Still other sensors, such as temperature sensors, may be included, for example, coupled to the underbody emission control device(s). As elaborated in FIG. 1, the exhaust gas sensors 126A, 126B, 127A and 127B may include exhaust gas oxygen sensors, such as EGO, HEGO or UEGO sensors.

One or more engine cylinders may be selectively deactivated during selected engine operating conditions. For example, during DFSO, one or more cylinders of an engine may be deactivated while the engine continues to rotate. The cylinder deactivation may include deactivating fuel and spark to the deactivated cylinders. In addition, air may continue to flow through the deactivated cylinders in which an exhaust gas sensor may measure a maximum lean air-fuel ratio upon entering the DFSO. In one example, an engine controller may selectively deactivate all the cylinders of an engine during a shift to DFSO and then reactivate all the cylinders during a shift back to non-DFSO mode.

FIG. 4 illustrates an example method 400 for determining DFSO conditions in a motor vehicle. DFSO may be used to increase fuel economy by shutting-off fuel injection to one or more cylinders of an engine. In some examples, an open-loop air-fuel ratio control during DFSO may be used to determine an air-fuel ratio of an engine cylinder, as will be described in more detail below. DFSO conditions are described in further detail below. Instructions for carrying out method 400 and the rest of the methods included herein may be executed by a controller based on instructions stored on a memory of the controller and in conjunction with signals received from sensors of the engine system, such as the sensors described above with reference to FIGS. 1-3. The controller may employ engine actuators of the engine system to adjust engine operation, according to the methods described below.

Method 400 begins at 402, which includes determining, estimating, and/or measuring current engine operating parameters. The current engine operating parameters may include a vehicle speed, throttle position, and/or an air-fuel ratio. At 404, the method 400 includes determining if one or more DFSO activation conditions are met. DFSO conditions may include but are not limited to one or more of an accelerator not being depressed 406, a constant or decreasing vehicle speed 408, and a brake pedal being depressed 410. An accelerator position sensor may be used to determine the accelerator pedal position. The accelerator pedal position may occupy a base position when the accelerator pedal is not applied or depressed, and the accelerator pedal may move away from the base position as accelerator application is increased. Additionally or alternatively, accelerator pedal position may be determined via a throttle position sensor in examples where the accelerator pedal is coupled to the throttle or in examples where the throttle is operated in an accelerator pedal follower mode. A constant or decreasing vehicle speed may be preferred for a DFSO to occur due to a torque demand being either constant or not increasing. The vehicle speed may be determined by a vehicle speed sensor. The brake pedal being depressed may be determined via a brake pedal sensor. In some examples, other suitable conditions may exist for DFSO to occur.

At 412, the method 400 judges if one or more of the above listed DFSO conditions is met. If the condition(s) is met, then the method 400 may proceed to method 500 to determine conditions for open-loop air-fuel ratio control as described in further detail with respect to FIG. 5. If none of the conditions are met, then the method 400 may proceed to 414 to maintain current engine operating parameters and not initiate DFSO. The method may exit after current engine operating conditions are maintained.

In some examples, a GPS/navigation system may be used to predict when DFSO conditions will be met. Information used by the GPS to predict DFSO conditions being met may include but is not limited to route direction, traffic information, and/or weather information. As an example, the GPS may be able to detect traffic downstream of a driver's current path and predict one or more of the DFSO condition(s) occurring. By predicting one or more DFSO condition(s) being met, the controller may be able to plan when to initiate DFSO.

Method 400 is an example method for a controller (e.g., controller 12) to determine if a vehicle may enter DFSO. Upon meeting one or more DFSO conditions, the controller (e.g., the controller in combination with one or more additional hardware devices, such as sensors, valves, etc.) may perform method 500 of FIG. 5.

FIG. 5 illustrates an exemplary method 500 for determining if open-loop air-fuel ratio control conditions are met. In one example, open-loop air-fuel ratio control may be initiated after a threshold number of vehicle miles are driven (e.g., 2500 miles). In another example, open-loop air-fuel ratio control may be initiated during the next DFSO event after sensing an air-fuel ratio imbalance during standard engine operating conditions (e.g., all cylinders of an engine are firing). During the open-loop air-fuel ratio control, a selected group of cylinders may be fired and their air-fuel ratio(s) may be detected, as will be discussed with respect to FIGS. 6-7. Based on the detected air-fuel ratios, injector fueling errors may be learned.

Method 500 will be described herein with reference to components and systems depicted in FIGS. 1-3, particularly, regarding engine 10, cylinder banks 30A and 30B, sensor 126A, sensor 127A, and controller 12. Method 500 may be carried out by the controller according to computer-readable media stored thereon. It should be understood that the method 500 may be applied to other systems of a different configuration without departing from the scope of this disclosure.

Method 500 may begin at 502, and initiate DFSO based on determination of DFSO conditions being met during method 400. Initiating DFSO includes shutting off a fuel supply to all the cylinders of the engine such that combustion may no longer occur (e.g., deactivating the cylinders). At 504, the method 500 determines if an air-fuel ratio imbalance was sensed during nominal engine operation prior to the DFSO, as described above. Additionally or alternatively, the method 500 may also determine if a threshold distance (e.g., 2500 miles) has been traveled by a vehicle since a prior open-loop air-fuel ratio control. If no air-fuel ratio imbalance was detected and/or the threshold distance was not traveled, then the method 500 proceeds to 506. At 506, method 500 continues operating the engine in DFSO mode until conditions are present where exiting DFSO is desired. In one example, exiting DFSO may be desired when a driver applies the accelerator pedal or when engine speed is reduced to less than a threshold speed. Method 500 exits if conditions are present to exit DFSO mode.

Returning to 504, if an air-fuel ratio imbalance was detected, then the method 500 may proceed to 508 to monitor if open-loop air-fuel ratio control is providing expected results. At 508, method 500 monitors conditions for entering open-loop air-fuel. For example, method 500 senses an air-fuel ratio or lambda in the exhaust system (e.g., via monitoring exhaust oxygen concentration) to determine if combusted byproducts have been exhausted from engine cylinders and the engine cylinders are pumping fresh air. After DFSO is initiated, the engine exhaust evolves progressively leaner until the lean air-fuel ratio reaches a saturated value. The saturated value may correspond to an oxygen concentration of fresh air, or it may be slightly richer than a value that corresponds to fresh air since a small amount of hydrocarbons may exit the cylinders even though fuel injection has been cut-off for several engine revolutions. Method 500 monitors the engine exhaust to determine if oxygen content in the exhaust has increased to greater than a threshold value. The conditions may further include identifying if a vehicle is driving at a constant speed. In this way, results measured for each cylinder group may be more consistent than results measured during varying vehicle speed. Method 500 continues to 510 after beginning to monitor the exhaust air-fuel ratio.

At 510, method 500 judges if conditions to enter open-loop air-fuel control have been met. In one example, the select conditions are that the exhaust air-fuel ratio is leaner that a threshold value for a predetermined amount of time (e.g., 1 second). In one example, the threshold value is a value that corresponds to being within a predetermined percentage (e.g., 10%) of a fresh air reading sensed at the oxygen sensor. If the conditions are not met, then the method 500 returns to 508 to continue to monitor if select conditions for entering open-loop air-fuel control have been met. If the conditions for open-loop air-fuel ratio control are met, the method proceeds to 512 to initiate open-loop air-fuel ratio control. After open-loop air-fuel ratio control has been initiated, the method proceeds to 514.

At 514, the method includes determining cylinder air-fuel ratio imbalance based on the output of an exhaust gas sensor. This includes, at 516, learning the air-fuel ratio imbalance based on (only) a HEGO sensor response during a first condition. The first condition may include, for example, the UEGO sensor being degraded or sensitive to only cylinders near the sensor (such as cylinders within a threshold distance of the sensor) and not responsive to cylinders afar (such as cylinders outside a threshold distance of the sensor). As another example, at 518, determining cylinder imbalance may include learning an air-fuel ratio imbalance based on each of a HEGO and a UEGO sensor response during a second condition. The second condition may include, for example, a UEGO sensor is not degraded and/or sensor readings are not biased towards cylinders in the vicinity of the UEGO sensor (such as cylinders within a threshold distance of the sensor). In response to the first condition, the method 500 may then proceed to method 600 to determine cylinder air-fuel ratio imbalance based on the HEGO sensor response, otherwise during the second condition, method 500 proceeds to method 700 to determine cylinder air-fuel ratio imbalance based on the HEGO and/or UEGO sensor response. The method for operation of open-loop air-fuel ratio control will be described with respect to FIGS. 6-7. It will be appreciated that in still further examples, such as during a third condition where the HEGO sensor is degraded, determining the cylinder air-fuel ratio imbalance may include learning the air-fuel ratio imbalance based on (only) a UEGO sensor response.

The methods disclosed herein stand in contrast to those of state-of-the-art air-fuel ratio imbalance monitoring, in which the air-fuel ratio imbalance monitoring relies on the exhaust sensor to accurately measure an air-fuel ratio relative to stoichiometry. The inventors herein have determined that these measurements may be inaccurate due to a geometry of an exhaust passage relative to a location of an exhaust sensor. Additionally or alternatively, this type of air-fuel ratio monitoring may not accurately determine a single cylinder air-fuel ratio while combusting air-fuel mixtures in one or more other cylinders of an engine. The inventors have further determined that during DFSO, an air-fuel ratio imbalance may be detected by firing a cylinder group, comprising at least a cylinder, after a threshold lean air-fuel ratio has been reached. In this way, the method may compare a difference between a lambda of the cylinder group and the threshold lean air-fuel ratio to a difference between an expected lambda of the cylinder group and the threshold lean air-fuel ratio.

Method 500 may be stored in non-transitory memory of controller (e.g., controller 12) to determine if a vehicle may initiate open-loop air-fuel ratio control during DFSO. Upon meeting one or more open-loop air-fuel ratio control conditions, the controller (e.g., the controller in combination with one or more additional hardware devices, such as sensors, valves, etc.) may perform method 600 of FIG. 6. Method 600 will be described herein with reference to components and systems depicted in FIGS. 1-3, particularly, regarding engine 10, cylinder banks 30A and 30B, sensor 127, and controller 12. Method 600 may be carried out by the controller executing computer-readable media stored thereon. It should be understood that the method 600 may be applied to other systems of a different configuration without departing from the scope of this disclosure.

FIG. 6 illustrates an exemplary method 600 for performing the open-loop air-fuel ratio control based on a HEGO sensor response (such as during a first condition). The first condition may include the HEGO sensor response reaching its full lean saturated value. In one example, open-loop air-fuel ratio control may select a cylinder group in which to reactivate combusting air-fuel mixtures and monitor the air-fuel ratio of the cylinder group during the DFSO. The cylinder group may be a pair of corresponding cylinders of separate cylinder banks, such as a first cylinder on each bank. The cylinders corresponding to one another on separate banks may have a common firing order or location. For example, the selected cylinders may be first firing cylinders of each bank, or cylinders located at one end of each bank. As an example, with respect to FIG. 3, cylinders A1 and B1 may comprise a cylinder group. Alternatively, the cylinders may be selected to combust air-fuel mixtures 360 crankshaft degrees apart to provide even firing and smooth torque production.

The approach described herein senses changes in output of a downstream heated exhaust gas oxygen (HEGO) sensor correlated to combustion events in cylinders that are reactivated during the DFSO event where the engine rotates and a portion of engine cylinders do not combust air-fuel mixtures. The HEGO sensor outputs a signal that is proportionate to oxygen concentration in the exhaust. And, since only one cylinder of a cylinder bank may be combusting air and fuel at a time, the oxygen sensor output may be indicative of cylinder air-fuel imbalance for the cylinder combusting air and fuel. Thus, the present approach may increase a signal to noise ratio for determining cylinder air-fuel imbalance. In one example, the HEGO sensor output voltage (converted to air-fuel ratio or lambda (e.g., air-fuel stoichiometric)) is sampled for every cylinder firing during a cylinder group firing after exhaust valves of the cylinder receiving fuel are opened. The sampled oxygen sensor signal is then evaluated to determine a lambda value or air-fuel ratio. The lambda value is expected to correlate to a demanded lambda value.

Method 600 begins at 602 where a cylinder group is selected to be fired during the open-loop air-fuel ratio control. In some examples, the cylinder group may comprise only one cylinder. In other examples, the cylinder group may comprise a plurality of cylinders with at least one cylinder selected from each cylinder bank. Selection of the cylinder group may include selecting a number and identity of cylinders, the selection based on one or more of a firing order and cylinder location. As one example, with respect to FIG. 3, the cylinders most upstream from an exhaust gas sensor (e.g., sensor 126) on each cylinder bank may be selected as the cylinder group (e.g., cylinders A1 and B1). Additionally or alternatively, cylinders with a common firing order on each bank may be selected as the cylinder group (e.g., cylinders A1 and B3). In some examples, the cylinders may combust 360 degrees apart to smooth engine torque production. Consequently, cylinders may be similar in firing order and location.

After selecting the cylinder group, method 600 proceeds to 603 to determine if conditions for fuel injection to the selected cylinder group are met. Conditions for initiating fuel injection may be determined as described in method 1000 of FIG. 10. In particular, method 1000 includes determining whether or not to supply fuel to cylinders of a selected cylinder group (during learning of cylinder air-fuel imbalance) based on current engine operating conditions. In one example, fueling may be started for a selected cylinder group in response to a threshold duration having elapsed since a last injector error learning for the cylinder group. If the fuel injection conditions are not met, then the method 600 may proceed to 604 to continue to monitor fuel injection conditions until fuel injection conditions are met.

If the fuel injection conditions are met, the method 600 may proceed to 605 to fire the selected cylinder group by injecting an amount of fuel and combusting an air-fuel mixture in the selected cylinder group. In one example, injecting an amount of fuel includes, at 606, during a first operating condition, injecting a different amount of fuel in each cylinder of the selected cylinder group while maintaining the remaining cylinders deactivated (e.g., no fuel injected) while the engine continues to rotate. The quantity of fuel that is injected in each cylinder may be adjusted to provide a defined exhaust air-fuel ratio perturbation upon firing the cylinders of the selected cylinder group. The first operating condition may include an availability of a known HEGO deviation that may be used for calibration. Alternatively, the injecting an amount may include, at 607, during a second operating condition, injecting a fixed quantity of fuel in each cylinder of the selected cylinder group while maintaining the remaining cylinders deactivated. The fixed quantity of fuel that is injected in each cylinder may provide different exhaust air-fuel ratio perturbations in cylinders of the selected cylinder group, each perturbation based on the amount of fuel injected. The second operating condition may include determining specific HEGO deviations in advance to maintain a well-balanced engine.

After injecting fuel in cylinders of the selected cylinder group, method 600 may fire the selected group of cylinders one or more times to produce a perturbation of exhaust air-fuel ratio after combustion products are exhausted after each combustion event in the firing cylinder. For example, if the selected cylinder group comprises cylinders A1 and B1, then both cylinder A1 and cylinder B1 fire. Firing cylinder A1 produces an exhaust air-fuel ratio perturbation that is sensed at an exhaust gas sensor, such as a HEGO sensor (e.g., sensor 127A at FIG. 3) after the combusted mixture in cylinder A1 is expelled to the exhaust system. Likewise, firing cylinder B1 produces an exhaust air-fuel ratio perturbation that is also sensed via an exhaust gas sensor, such as a HEGO sensor (e.g., 127B at FIG. 3) after the combusted mixture in cylinder B1 is expelled to the exhaust system. In other words, the combustion gases from cylinders A1 and B1 drive down (e.g., enrichen) the lean exhaust air-fuel ratios sensed in the respective exhaust passages when all cylinders were deactivated. As mentioned above, a selected cylinder (s) may combust air and fuel over one or more engine cycles while other cylinders remain deactivated and not receiving fuel.

As depicted in FIG. 3, firing the selected cylinder comprising cylinder A1 and cylinder B1 results in exhaust gas from cylinder A1 flowing to sensor 127A and exhaust gas from cylinder B1 flowing to sensor 127B. In this way, each sensor measures only the exhaust gas of an individual cylinder and as a result, sensor blindness may be circumvented.

At 608, the method 600 estimates a lambda value each time combustion byproducts are released into the exhaust system from a cylinder combusting air and fuel. The lambda value may be correlated to the amount of fuel injected to the cylinder, and the amount of fuel injected to the cylinder may be provided by adjusting a fuel pulse width applied to a fuel injector of the cylinder receiving fuel. As one example, during the first operating condition, different amounts of fuel may be injected in each cylinder of the selected cylinder group to produce fixed lambda values for each cylinder. Alternatively, during the second operating condition, a fixed quantity of fuel may be injected in each cylinder of the selected cylinder group to produce different lambda values for each cylinder.

After lambda values are determined, it is judged whether or not the actual lambda values differ from expected lambda values. The expected lambda values may be based on one or more of a cylinder position in a cylinder bank, a total amount of fuel supplied to the cylinder, engine temperature, engine firing order, fueling timing, and torque transmitted though the transmission. For example, where a fixed amount of fuel is added, the expected lambda value may correspond to the fixed amount. As another example, where a varied amount of fuel is added, the expected lambda value may correspond to the fixed lambda associated with the varied amount of fuel.

Cylinder to cylinder air-fuel imbalance may result from an air-fuel ratio of one or more cylinders deviating from a desired or expected engine air-fuel ratio. A difference between the actual cylinder lambda and expected lambda may be determined for one or an average of lambda values and an injector fueling error may be learned based on the actual lambda values at 609.

At 609, method 600 includes learning the injector fueling error. Learning the injector fueling error includes determining if the cylinder air-fuel ratio is leaner (e.g., excess oxygen) or richer (e.g., excess fuel) than expected and storing the learned error for future operation of the cylinder following termination of the DFSO. Specifically at 610, during the first operating condition, the injector fueling error is learned based on comparing the actual HEGO lambda values of each cylinder of the selected cylinder group to the expected fixed lambda value. Alternatively at 611, during the second operating condition, the fueling error may be learned based on comparing actual HEGO lambda values of each cylinder of the selected cylinder group to the expected lambda value of each cylinder of the group based on the corresponding injection amount. If the lambda value determined at 608 is less than the threshold range of the expected lambda value (e.g., rich air-fuel ratio) of a cylinder, then a controller may learn to inject less fuel during future combustion events in that cylinder based on a magnitude of the error. The magnitude of the lambda error may be equal to a difference between the expected lambda value and the actual lambda value determined at 608. Learning may include storing a difference between the expected lambda value and the actual lambda value in memory as a function of the identity of the assessed cylinder. As one example, responsive to a first rich lambda variation in a cylinder group (wherein the actual lambda is richer than the expected lambda), the controller may learn a first error and during subsequent operation, the fueling of the cylinder group may be enleaned as a function of the first air-fuel error. Likewise, responsive to a second lean lambda variation in a cylinder group (wherein the actual lambda is leaner than the expected lambda), the controller may learn a second air-fuel error and during subsequent operation, the fueling of the cylinder group may be enriched as a function of the second air-fuel error. For example, if a lambda value of a cylinder of a selected cylinder group is 1.8 and the expected lambda value is 1.7, then a lean air-fuel ratio lambda variation may exist with a magnitude of 0.1. The magnitude may be learned and applied to future combustion in the first cylinder group subsequent to the DFSO such that a fuel injection may compensate the lambda variation of 0.1 (e.g., inject an amount of fuel in excess of the determined amount, the extra fuel proportional to the magnitude of 0.1) in the cylinder that exhibited the variation.

In another example, a single lambda value or an average of lambda values determined over several combustion events in a cylinder may be compared to an expected range of lambda values (e.g., 1.7λ-1.4λ). If the single lambda value or average of lambda values is in the expected range, no air-fuel ratio imbalance is detected. However, if the single lambda value or average of lambda values is outside of the expected range, it may be determined that there is a cylinder air-fuel ratio imbalance. The controller may inject more or less fuel during future cylinder combustions based on a magnitude of difference between the range of lambda and the lambda value. In one example, if the expected value is a range between 1.7λ and 1.4λ, but the actual lambda value is 1.9λ, additional fuel may be injected to the cylinder because the lambda value of 1.9 is leaner than expected. The leaner lambda value is compensated by increasing the base amount of fuel injected to the cylinder by a factor based on the lambda error of 0.2.

It should also be noted that if a transmission shift request is made during the time fuel is injected to the reactivated cylinders, injection of fuel for injector error learning may be ceased until the shift is complete. Likewise, if a transmission shift request occurs during fuel injection into different cylinders, then fueling of cylinders and lambda variation analysis may be delayed until the shift is complete. By not performing cylinder fueling and learning cylinder imbalance during the transmission shift, the possibility of inducing a lambda variation may be reduced. Method 600 proceeds to 612 after learning air-fuel ratio imbalance in cylinders of the selected cylinder group.

At 612, the method 600 judges if all cylinders have been assessed and lambda values have been determined for all cylinders. If lambda values of all cylinders have not been assessed, then the answer is NO and method 600 proceed to 613. Otherwise, the answer is YES and method 600 proceeds to 616.

At 613, method 600 judges whether or not DFSO conditions are still present. A driver may apply an accelerator pedal during the injector error learning causing the DFSO condition to be exited. Alternatively, the operator may request to shut down the engine, causing the DFSO mode to be exited. If DFSO conditions are not met, the method 600 proceeds to 614. Otherwise, the method 600 proceeds to 615.

At 614, method 600 exits DFSO and returns to closed-loop air-fuel control. Cylinders are reactivated via supplying spark and fuel to the deactivated cylinders. In this way, the open-loop air-fuel ratio control is also disabled despite not having acquired lambda values for all cylinders of the engine. In some examples, if an open-loop air-fuel ratio control is disabled prematurely, then the controller may store any lambda values measured for a selected cylinder group(s) and consequently, select a different cylinder group(s) initially during the next open-loop air-fuel ratio control. Thus, if lambda values are not acquired for a cylinder group during an open-loop air-fuel ratio control, that cylinder group may be the first cylinder group for which lambda values are determined for establishing the presence or absence of imbalance during a subsequent DFSO event. The method 600 proceeds to exit after engine returns to closed-loop air-fuel control.

At 615, method 600 selects a next cylinder group for determining lambda values for establishing the presence or absence of imbalance. Selecting the next cylinder group may include selecting different cylinders other than the cylinders selected in the preceding cylinder group. For example with reference to FIG. 3, cylinders A3 and B3 may be selected after completing the analysis of cylinders A1 and B1. Additionally or alternatively, the method 600 may select cylinder groups sequentially along a cylinder bank. For example, cylinders A2 and B3 may comprise a cylinder group after firing cylinders A1 and B1 of a selected cylinder group. Method 600 returns to 603 to reiterate the fuel injector learning by reactivating the selected cylinder group and monitoring differences between an expected and an actual exhaust air-fuel ratio, as described above. This continues until all cylinders have been assessed.

After assessing all the cylinders, at 616, method 600 deactivates open-loop air-fuel ratio control including terminating cylinder activation and selection of cylinder groups. Thereafter, method 600 returns to resume DFSO where all cylinders are deactivated and where cylinder imbalance is not determined. Method 600 proceeds to 618 after the engine enters DFSO.

At 618, method 600 judges whether or not DFSO conditions are still present. If the answer is NO, method 600 proceeds to 620. Otherwise, the answer is YES and method 600 returns to 618 to maintain DFSO operation. DFSO conditions may no longer be met if the accelerator pedal is applied or torque demand increases.

At 620, the method 600 exits DFSO and reactivates all cylinders in closed-loop fuel control. The cylinders may be reactivated according to the firing order of the engine. Reactivating the cylinders includes resuming fuel and spark to the engine. Method 600 proceeds to 622 after engine cylinders are reactivated.

At 622, method 600 adjusts operation of any cylinders exhibiting lambda variation based on the corresponding injector error learned at 609. The adjusting may include adjusting amounts of fuel injected to engine cylinders, such as via adjustments to a fuel pulse width and/or a fuel injection timing. The fuel injection timing adjustments may be proportional to the difference between the expected lambda value and the determined lambda value as described at 609. For example, if the expected lambda value is 1.7 and the measured lambda value is 1.5, then the error magnitude may be equal to 0.2, indicating a rich air-fuel ratio deviation in the particular cylinder. The adjusting may further include injecting a greater amount of fuel or a lesser amount of fuel via pulse width adjustments based on the type of lambda error. For example, if one cylinder indicates rich lambda variation or error, then the adjustments may include one or more of injecting less fuel and providing more air to the cylinder. The method 600 may exit after applying the adjustments corresponding to the learned lambda errors for each cylinder.

In one example, where the engine is a six cylinder engine having two cylinder banks, the method described in FIGS. 4-6 may determine air-fuel imbalance for cylinders of a cylinder bank with cylinders 1-3 during the first operating condition based on the following equations:

$$k1*mf1=M*H_V \quad \text{Eq. 1}$$

$$k2*mf2=M*H_V \quad \text{Eq. 2}$$

$$k3*mf3=M*H_V \quad \text{Eq. 3}$$

where mf1 is mass of fuel injected to cylinder 1 during DFSO, mf2 is mass of fuel injected to cylinder 2 during DFSO, mf3 is mass of fuel injected to cylinder 3 during DFSO. The coefficients k1, k2 and k3 are coefficients of injector error and may be used to indicate air-fuel imbalance in cylinders 1, 2 and 3, respectively. The values of k1, k2 and k3 are determined via solving the three equations for the three unknowns. The coefficient M is a constant, independent of the air-fuel imbalance. The coefficient H_V is a fixed HEGO lambda response from the first, second and third cylinder.

Alternatively, during the second operating condition, the air-fuel imbalance for cylinders of the cylinder bank with cylinders 1-3 may be determined based on the following equations:

$$k1*mf=M*H_V1 \quad \text{Eq. 4}$$

$$k2*mf=M*H_V2 \quad \text{Eq. 5}$$

$$k3*mf=M*H_V3 \quad \text{Eq. 6}$$

where mf is mass of fuel injected to cylinders 1-3 during DFSO, coefficients k1, k2 and k3 are coefficients of injector error and may be used to indicate air-fuel imbalance in cylinders 1, 2 and 3, respectively. The values of k1, k2 and k3 are determined via solving the three equations for the three unknowns. The coefficient M is a constant, independent of the air-fuel imbalance. The coefficient H_V1 is the HEGO lambda response from the first cylinder, H_V2 is the HEGO lambda response from the second cylinder, and H_V3 is the HEGO lambda response from the third cylinder.

Thus, the method of FIG. 6 provides for a method, comprising: during a deceleration fuel shut-off (DFSO) event, sequentially firing cylinders of a cylinder group, each fueled with a fuel pulse width selected to provide an expected air-fuel deviation; and indicating an air-fuel ratio variation for each cylinder based on an error between an actual air-fuel deviation from a maximum lean air-fuel ratio during the DFSO relative to the expected air-fuel deviation. The expected air-fuel deviation may be an expected air-fuel deviation at an exhaust gas sensor coupled downstream of an exhaust catalyst, wherein the actual air-fuel deviation is estimated by the exhaust gas sensor coupled downstream of the exhaust catalyst, and wherein the exhaust gas sensor is a heated exhaust gas sensor. Additionally or optionally, the expected air-fuel deviation may be based on a sensitivity of the exhaust gas sensor and further based on a minimum pulse width of an injector of the cylinder group. Alternatively, the expected air-fuel deviation may be further based on one or more of engine speed, engine temperature, and engine load. The method may further comprise, during subsequent engine operation with all engine cylinders firing, adjusting cylinder fueling based on the indicated air-fuel ratio variation. Furthermore, adjusting cylinder fueling may include adjusting a fuel injector pulse width for the cylinder based on the air fuel error. The fuel injection may also include determining an amount of fuel injected, in which the amount of fuel injected may be less than a threshold injection. The threshold injection may be based on a drivability, in which injecting an amount of fuel greater than the threshold injection may reduce drivability.

FIG. 7 illustrates an exemplary method 700 for preforming the open-loop air-fuel ratio control based on each of a HEGO and a UEGO response during a second condition when both the UEGO and HEGO sensors are not degraded and UEGO sensor is not known to be sensitive or biased to particular cylinders (such as cylinders within a threshold distance of the UEGO sensor). Method 700 will be described herein with reference to components and systems depicted in FIGS. 1-3, particularly, regarding engine 10, cylinder banks 30A and 30B, sensor 127, and controller 12. Method 700 may be carried out by the controller executing computer-readable media stored thereon. It should be understood that the method 700 may be applied to other systems of a different configuration without departing from the scope of this disclosure.

In one example of method 700, open-loop air-fuel ratio control may select a cylinder group in which to reactivate combusting air-fuel mixtures and monitor the air-fuel ratio of the cylinder group during the DFSO. The cylinder group may be a pair of corresponding cylinders of separate cylinder banks, such as a first cylinder on each bank. The cylinders corresponding to one another on separate banks may have a common firing order or location. For example, the selected cylinders may be first firing cylinders of each bank, or cylinders located at one end of each bank. As an example, with respect to FIG. 3, cylinders A1 and B1 may comprise a cylinder group. Alternatively, the cylinders may be selected to combust air-fuel mixtures 360 crankshaft degrees apart to provide even firing and smooth torque production.

The approach described herein senses changes in output of a downstream heated exhaust gas oxygen (HEGO) sensor and changes in output of an upstream exhaust gas oxygen (UEGO) sensor, both sensor outputs correlated to combustion events in cylinders that are reactivated during the DFSO event where the engine rotates and a portion of engine cylinders do not combust air-fuel mixtures. Both HEGO and UEGO sensors output a signal that is proportionate to oxygen concentration in the exhaust. And, since only one cylinder of a cylinder bank may be combusting air and fuel, the oxygen sensor output may be indicative of cylinder air-fuel imbalance of the cylinder combusting air and fuel. Thus, the present approach may increase a signal to noise ratio for determining cylinder air-fuel imbalance. In one example, the HEGO and UEGO sensor output voltage (converted to air-fuel ratio or lambda (e.g., air-fuel subtracted from air-fuel stoichiometric)) is sampled for every cylinder firing during a cylinder group firing after exhaust valves of the cylinder receiving fuel are opened. The sampled oxygen sensor signal is then evaluated to determine a HEGO and UEGO lambda value. Both lambda values are expected to correlate to demanded lambda values.

Method 700 begins at 702 where a cylinder group is selected to be fired during the open-loop air-fuel ratio control. In some examples, the cylinder group may comprise only one cylinder. In other examples, the cylinder group may comprise a plurality of cylinders with at least one cylinder selected from each cylinder bank. Selection of the cylinder group may include selecting a number and identity of cylinders, the selection based on one or more of a firing order and cylinder location. As one example, with respect to FIG. 3, the cylinders most upstream from an exhaust gas sensor (e.g., sensor 126) on each cylinder bank may be selected as the cylinder group (e.g., cylinders A1 and B1). Additionally or alternatively, cylinders with a common firing order on each bank may be selected as the cylinder group (e.g., cylinders A1 and B3). In some examples, the cylinders may combust 360 degrees apart to smooth engine torque production. Consequently, cylinders may be similar in firing order and location.

After selecting the cylinder group, method 700 proceeds to 703 to determine if conditions for fuel injection to the selected cylinder group are met. Conditions for initiating fuel injection may be determined as described in method 1000 of FIG. 10. In particular, method 1000 includes determining whether or not to supply fuel to cylinders of a selected cylinder group (during learning of cylinder air-fuel imbalance) based on current engine operating conditions. In one example, fueling may be started for a selected cylinder group in response to a threshold duration having elapsed since a last injector error learning for the cylinder group. If the fuel injection conditions are not met, then the method 700 may proceed to 704 to continue to monitor fuel injection conditions until fuel injection conditions are met.

If the fuel injection conditions are met, the method 700 may proceed to 705 to fire the selected cylinder group by injecting an amount of fuel and combusting an air-fuel mixture in the selected cylinder group. In one example, injecting an amount of fuel includes, at 706, during a first condition, injecting a different amount of fuel in each cylinder of the selected cylinder group while maintaining the remaining cylinders deactivated (e.g., no fuel injected) while the engine continues to rotate. The quantity of fuel that is injected in each cylinder may be adjusted to provide a defined exhaust air-fuel ratio perturbation upon firing the cylinders of the selected cylinder group. The first operating condition may include availability of a known HEGO deviation that may be used for calibration. Alternatively, the injecting an amount of fuel may include, at 707, during a second condition, injecting fixed quantity of fuel in each cylinder of the selected cylinder group while maintaining the remaining cylinders deactivated. The fixed quantity of fuel that is injected in each cylinder may provide different exhaust air-fuel ratio perturbations in cylinders of the selected cylinder group, the perturbations corresponding to the injection amount. The second operating condition may include determining specific HEGO deviations in advance to maintain a well-balanced engine (or to maintain a cylinder-to-cylinder imbalance at less than a threshold level).

After injecting fuel in cylinders of the selected cylinder group, method 700 may fire the selected group of cylinders one or more times to produce a perturbation of exhaust air-fuel ratio after combustion products are exhausted after each combustion event in the firing cylinder. For example, if the selected cylinder group comprises cylinders A1 and B1, then both cylinder A1 and cylinder B1 fire. Firing cylinder A1 produces an air-fuel perturbation in exhaust sensed via the oxygen sensors (e.g., 126A and 127A, FIG. 3) after the combusted mixture in cylinder A1 is expelled to the exhaust system. Firing cylinder B1 produces an air-fuel perturbation in the exhaust sensed via the oxygen sensors (e.g., 126B and 127B, FIG. 3) after the combusted mixture in cylinder B1 is expelled to the exhaust system. In other words, the combustion gases from cylinders A1 and B1 drive down (e.g., richen) the lean exhaust air-fuel ratios sensed in the respective exhaust passages when all cylinders were deactivated. As mentioned above, a selected cylinder(s) may combust air and fuel over one or more engine cycles while other cylinders remain deactivated and not receiving fuel.

As depicted in FIG. 3, firing the selected cylinder comprising cylinder A1 and cylinder B1 results in exhaust gas from cylinder A1 flowing to sensors 126A and 127A, and exhaust gas from cylinder B1 flowing to sensors 126B and 127B. In this way, each pair of sensors measures only the exhaust gas of an individual cylinder and as a result, sensor blindness may be circumvented.

At 708, the method 700 estimates a HEGO and/or UEGO lambda value each time combustion byproducts are released into the exhaust system from a cylinder combusting air and fuel. Both the HEGO and UEGO lambda values may be correlated to the amount of fuel injected into the cylinder, and the amount of fuel injected to the cylinder may be provided by adjusting a fuel pulse width applied to a fuel injector of the cylinder receiving fuel. As one example, during the first condition, different amounts of fuel may be injected in each cylinder of the selected cylinder group to produce fixed lambda values for each firing cylinder. Alternatively, during the second condition, a fixed quantity of fuel may be injected in each cylinder of the cylinder group to produce different lambda values for each cylinder.

After HEGO and/or UEGO lambda values are determined, it is judged whether or not the actual lambda values differ from expected lambda values. The expected lambda values may be based on one or more of a cylinder position in a cylinder bank, a total amount of fuel supplied to the cylinder, engine temperature, engine firing order, fueling timing, and torque transmitted though the transmission. For example, where a fixed amount of fuel is added, the expected lambda value may correspond to the fixed amount. As another example, where a varied amount of fuel is added, the expected lambda value may correspond to the fixed lambda associated with the varied amount of fuel.

Cylinder to cylinder air-fuel imbalance may result from an air-fuel ratio of one or more cylinders deviating from a desired or expected air-fuel ratio. A difference between the actual cylinder lambda and expected lambda may be determined for one or an average of lambda values and an injector fueling error may be learned based on the actual lambda values at 709. At 709, method 700 includes learning the injector fueling error. Learning the injector fueling error includes determining if the cylinder air-fuel ratio is leaner (e.g., excess oxygen) or richer (e.g., excess fuel) than expected and storing the learned error for future operation of the cylinder following termination of the DFSO. Specifically at 710, during the first condition, the injector fueling error is learned based on comparing the actual HEGO and/or UEGO lambda values of each cylinder of the selected cylinder group to the expected fixed HEGO and/or UEGO lambda value. Alternatively at 711, during the second condition, the fueling error may be learned based on comparing actual HEGO and/or UEGO lambda values for each cylinder of the selected cylinder group, to the expected HEGO and/or UEGO lambda value of each cylinder of the group based on the corresponding injection amount. If the HEGO and/or UEGO lambda value determined at 708 is less than the threshold range of the expected HEGO and/or UEGO lambda value (e.g., rich air-fuel ratio) of a cylinder, then a controller may learn to inject less fuel during future combustion events in that cylinder based on a magnitude of the error. The magnitude of the HEGO lambda error may be equal to a difference between the expected HEGO lambda value and the actual HEGO lambda value, while the UEGO lambda error may be equal to a difference between the expected UEGO lambda value and the actual UEGO lambda value determined at 708. Learning may include storing a difference between the expected HEGO and/or UEGO lambda value and the actual HEGO and/or UEGO lambda value in memory as a function of the identity of the assessed cylinder. As one example, responsive to a first rich HEGO and/or UEGO lambda variation in a cylinder group (wherein the actual lambda is richer than the expected lambda), the controller may learn a first air-fuel error and during subsequent operation, the fueling of the cylinder group may be enleaned as a function of the first air-fuel error. Likewise, responsive to a second lean HEGO and/or UEGO lambda variation in a cylinder group (wherein the actual lambda is leaner than the expected lambda), the controller may learn a second air-fuel error and during subsequent operation, the fueling of the cylinder group may be enriched as a function of the second air-fuel error. For example, if the exhaust gas is sufficiently mixed and the HEGO sensor is adequately warmed up, the HEGO sensor may be used to detect cylinder air-fuel ratio imbalance. In another example, the UEGO sensor may be degraded or the UEGO sensor may be selectively more sensitive to cylinders within a threshold distance of the UEGO sensor and less sensitive to cylinders outside the threshold distance. In this case, the HEGO sensor may be used to identify cylinder to cylinder air-fuel imbalance. If the HEGO lambda value of a cylinder of a selected cylinder group is 1.8 and the expected HEGO lambda value is 1.7, then a lean air-fuel ratio lambda variation may exist with a magnitude of 0.1. The magnitude may be learned and applied to future combustion in the first cylinder group subsequent to the DFSO such that a fuel injection may compensate the lambda variation of 0.1 (e.g., inject an amount of fuel in excess of the determined amount, the extra fuel proportional to the magnitude of 0.1) in the cylinder that exhibited the variation.

In another example during cold start conditions where the HEGO is not active, or when the HEGO is degraded, the UEGO sensor may be used to learn cylinder air-fuel imbalance. A single lambda value or an average of lambda values determined over several combustion events in a cylinder may be compared to an expected range of lambda values (e.g., 2.0λ-1.8λ). If the single lambda value or average of lambda values is in the expected range, no air-fuel ratio imbalance is detected. However, if the single lambda value or average of lambda values is outside of the expected range, it may be determined that there is a cylinder air-fuel ratio imbalance. The controller may inject more or less fuel during future cylinder combustions based on a magnitude of difference between the range of lambda and the lambda value. In one example, if the expected value is a range between 2.0λ and 1.8λ, but the actual lambda value is 2.1λ, additional fuel may be injected to the cylinder because the lambda value of 2.1 is leaner than expected. The leaner lambda value is compensated by increasing the base amount of fuel injected to the cylinder by a factor based on the lambda error of 0.1.

It should also be noted that if a transmission shift request is made during the time fuel is injected to the reactivated cylinders, injection of fuel for injector error learning may be ceased until the shift is complete. Likewise, if a transmission shift request occurs during fuel injection into different cylinders, then fueling of cylinders and lambda variation analysis may be delayed until the shift is complete. By not performing cylinder fueling and learning cylinder imbalance during the transmission shift, the possibility of inducing a lambda variation may be reduced. Method 700 proceeds to 712 after learning air-fuel ratio imbalance in cylinders of the selected cylinder group.

At 712, the method 700 judges if all cylinders have been assessed and lambda values have been determined for all cylinders. If lambda values of all cylinders have not been assessed, then the answer is NO and method 700 proceed to 713. Otherwise, the answer is YES and method 700 proceeds to 716.

At 713, method 700 judges whether or not DFSO conditions are still present. A driver may apply an accelerator pedal during the injector error learning causing the DFSO condition to be exited. Alternatively, the operator may request to shut down the engine, causing the DFSO mode to be exited. If DFSO conditions are not met, the method 700 proceeds to 714. Otherwise, the method 700 proceeds to 715.

At 714, method 700 exits DFSO and returns to closed-loop air-fuel control. Cylinders are reactivated via supplying spark and fuel to the deactivated cylinders. In this way, the open-loop air-fuel ratio control is also disabled despite not having acquired lambda values for all cylinders of the engine. In some examples, if an open-loop air-fuel ratio control is disabled prematurely, then the controller may store any lambda values measured for a selected cylinder group(s) and consequently, select a different cylinder group(s) initially during the next open-loop air-fuel ratio control. Thus, if lambda values are not acquired for a cylinder group during an open-loop air-fuel ratio control, that cylinder group may be the first cylinder group for which lambda values are determined for establishing the presence or absence of imbalance during a subsequent DFSO event. The method 700 proceeds to exit after engine returns to closed-loop air-fuel control.

At 715, method 700 selects a next cylinder group for determining lambda values for establishing the presence or absence of imbalance. Selecting the next cylinder group may include selecting different cylinders other than the cylinders selected in the preceding cylinder group. For example with reference to FIG. 3, cylinders A3 and B3 may be selected after completing the analysis of cylinders A1 and B1. Additionally or alternatively, the method 700 may select cylinder groups sequentially along a cylinder bank. For example, cylinders A2 and B3 may comprise a cylinder group after firing cylinders A1 and B1 of a selected cylinder group. Method 700 returns to 703 to reiterate the fuel injector learning by reactivating the selected cylinder group and monitoring differences between an expected and an actual exhaust air-fuel ratio, as described above. This continues until all cylinders have been assessed.

After assessing all the cylinders, at 716, method 700 deactivates open-loop air-fuel ratio control including terminating cylinder activation and selection of cylinder groups. Thereafter, method 700 returns to resume DFSO where all cylinders are deactivated and where cylinder imbalance is not determined. Method 700 proceeds to 718 after the engine enters DFSO.

At 718, method 700 judges whether or not DFSO conditions are still present. If the answer is NO, method 700 proceeds to 720. Otherwise, the answer is YES and method 700 returns to 718 to maintain DFSO operation. DFSO conditions may no longer be met if the accelerator pedal is applied or torque demand increases.

At 720, the method 700 exits DFSO and reactivates all cylinders in closed-loop fuel control. The cylinders may be reactivated according to the firing order of the engine. Reactivating the cylinders includes resuming fuel and spark to the engine. Method 700 proceeds to 722 after engine cylinders are reactivated.

At 722, method 700 adjusts operation of any cylinders exhibiting lambda variation based on the corresponding injector error learned at 709. The adjusting may include adjusting amounts of fuel injected to engine cylinders, such as via adjustments to a fuel pulse width and/or a fuel injection timing. The fuel injection timing adjustments may be proportional to the difference between the expected lambda value and the determined lambda value as described at 709. For example, if the expected HEGO lambda value is 1.7 and the measured HEGO lambda value is 1.5, then the error magnitude may be equal to 0.2, indicating a rich air-fuel ratio deviation in the particular cylinder. The adjusting may further include injecting a greater amount of fuel or a lesser amount of fuel via pulse width adjustments based on the type of lambda error. For example, if one cylinder indicates rich lambda variation or error, then the adjustments may include one or more of injecting less fuel and providing more air to the cylinder. The method 700 may exit after applying the adjustments corresponding to the learned lambda errors for each cylinder.

In one example, where the engine is a six cylinder engine having two cylinder banks, the method described in FIGS. 4-5 and FIG. 7 may determine air-fuel imbalance for cylinders of a cylinder bank with cylinders 1-3 based on the following equations:

$$k1*\mathrm{mf}=M*V1 \quad \text{Eq. 7}$$

$$k2*\mathrm{mf}=M*V2 \quad \text{Eq. 8}$$

$$k3*\mathrm{mf}=M*V3 \quad \text{Eq. 9}$$

where mf is mass of fuel injected to cylinders 1-3 during DFSO, coefficients k1, k2 and k3 are coefficients of injector error and may be used to indicate air-fuel imbalance in cylinders 1, 2 and 3, respectively. The values of k1, k2 and k3 are determined via solving the three equations for the three unknowns. The coefficient M is a constant, independent of the air-fuel imbalance. The coefficient V1 is the HEGO or UEGO lambda value from the first cylinder, V2 is the HEGO or UEGO lambda value from the second cylinder, and V3 is the HEGO or UEGO lambda value from the third cylinder.

FIG. 8 depicts an operating sequence 800 illustrating example results for an engine cylinder bank comprising three cylinders (e.g., V6 engine with two cylinder banks, each bank comprising three cylinders). Line 802 represents if DFSO is occurring or not, line 804 represents operating state (active or deactivated) of an injector of a first cylinder, line 806 represents operating state (active or deactivated) of an injector of a second cylinder, and line 808 represents operating state (active or deactivated) of an injector of a third cylinder. For lines 804, 806, and 808, a value of "1" represents a fuel injector injecting fuel (e.g., cylinder firing) and a value of "0" represents no fuel being injected (e.g., cylinder deactivated). Solid line 810 represents a heated exhaust gas sensor (HEGO) response in terms of voltage, dotted line 812 represents an expected lambda response, and line 814 represents a stoichiometric lambda value (e.g., 1). The horizontal axes of each plot represent time and time increases from the left side of the figure to the right side of the figure.

Prior to T1, the first, second, and third cylinders are firing under nominal engine operation (e.g., stoichiometric air-fuel ratio), as illustrated by lines 804, 806, and 808 respectively. As a result, the cylinders produce voltage values substantially equal to 0.1, as indicated by line 810. Higher voltage values indicate leaner air-fuel ratios while lower voltage values indicate richer air-fuel ratios. The voltage value may be calculated by a controller (e.g., controller 12 at FIG. 1) from oxygen concentration in the engine exhaust system as measured by an exhaust gas sensor. DFSO is disabled, as indicated by line 802.

At T1, DFSO conditions are met and DFSO is initiated. As a result of the DFSO, fuel is no longer injected into all the cylinders of the engine (that is, fuel and spark to all cylinders is deactivated) and the voltage begins to decrease as air is pumped though engine cylinders without injecting fuel.

After T1 and prior to T2, DFSO continues and the voltage continues to decrease and reaches a minimum voltage. The injectors may not begin injecting fuel until a threshold time (e.g., 5 seconds) has passed subsequent to initiating the DFSO. Additionally or alternatively, the injectors may begin injecting fuel in response to the minimum voltage being detected by the HEGO sensor. Conditions for firing a selected cylinder group are monitored between T1 and T2.

At T2, the first cylinder is activated due to conditions for firing the selected cylinder group being met (e.g., no zero point torque, vehicle speed is less than a threshold vehicle speed, and no downshift) and therefore, injector 1 is selectively reactivated to inject fuel into the first cylinder.

After T2 and prior to T3, the first cylinder is combusting. As shown, the first cylinder combusts two times and produces two separate fuel pulse widths, each fuel pulse width corresponding to a single combustion event. The exhaust oxygen concentration is measured by the HEGO sensor and the controller produces a voltage value corresponding to each combustion event based on a deviation from the minimum voltage. As will be appreciated by one skilled in the art, other suitable number of firings may be performed. As depicted, the fuel injections to the first cylinder produce different lambda values upon combustion. However, in some examples, the open-loop air-fuel ratio control may inject differing amounts of fuel such that each injection provides a substantially different amount of fuel injected but similar voltage values.

The first cylinder measured voltage values are compared to an expected voltage value, line 812. The expected voltage may be based on one or more of a cylinder position in a cylinder bank, a total amount of fuel supplied to the cylinder, engine firing order and fueling timing. If the measured voltage values are not equal to the expected voltage value, then an air-fuel ratio variation causing cylinder to cylinder air-fuel imbalance may be indicated and an injector error may be learned, as described above with respect to FIG. 6. In the depicted example, the first cylinder voltage values are equal to the expected voltage values, thus no air-fuel ratio variation or error value is learned for the first cylinder.

As one example, responsive to a first rich air-fuel variation in a cylinder (wherein the actual air-fuel ratio is richer than the expected air-fuel ratio), the controller may learn a first error and during subsequent operation, the fueling of the cylinder may be enleaned as a function of the first error. Likewise, responsive to a second lean air-fuel variation in a cylinder (wherein the actual air-fuel ratio is leaner than the expected air-fuel ratio), the controller may learn a second error and during subsequent operation, the fueling of the cylinder may be enriched as a function of the second error. For example, if an air-fuel value for the selected cylinder is 1.8 and the expected air-fuel ratio value is 1.7, then a lean air-fuel ratio variation may exist with a magnitude of 0.1. The magnitude may be learned and applied to future combustion in the cylinder subsequent to the DFSO such that a fuel injection may compensate the air-fuel variation of 0.1 (that is inject an amount of fuel in excess of the determined amount, the extra fuel proportional to the magnitude of 0.1).

In some examples, additionally or alternatively, the measured air-fuel ratio value may be compared to a threshold range, as described above. If the measured air-fuel ratio value is not within the threshold range, then an imbalance may be indicated and learned. Additionally or alternatively, in some examples, the open-loop air-fuel ratio control may operate for a given number of times and the results may be averaged to indicate an air-fuel ratio imbalance, if any.

At T3, the first cylinder is deactivated and DFSO continues. The voltage returns to the minimum voltage. After T3 and prior to T4, the DFSO continues without firing a selected cylinder group. As a result, the air-fuel ratio remains at the minimum voltage. The open-loop air-fuel ratio control may select a next cylinder group to fire. The open-loop air-fuel ratio control may allow the voltage to return to the minimum voltage prior to firing the next cylinder group in order maintain a consistent background (e.g., the minimum voltage) for each cylinder group. Conditions for firing the next cylinder group are monitored.

In some examples, additionally or alternatively, firing the next cylinder group may occur directly after firing a first cylinder group. In this way, the open-loop air-fuel ratio control may select the next cylinder group at T3 and not allow the voltage to return to the minimum voltage, for example.

At T4, the second cylinder is activated and injector 2 is selectively activated and fuel is injected into the second cylinder due to cylinder firing conditions being met. The DFSO continues and the first and third cylinders remain deactivated. After T4 and prior to T5, the second cylinder is fired two times and two fuel pulse widths are produced, each fuel pulse width corresponding to a single combustion event in the second cylinder. The exhaust oxygen concentration is converted into a measured voltage value corresponding to a voltage value for the second cylinder. The measured voltage values of the second cylinder are substantially equal to the expected voltage values. Therefore, no air-fuel ratio imbalance is learned.

At T5, the second cylinder is deactivated and as a result, the voltage value decreases towards the minimum voltage value, while DFSO continues. After T5 and prior to T6, the open-loop air-fuel ratio control selects a next cylinder group and allows the voltage to return to the minimum voltage prior to firing the next cylinder group. DFSO continues with all the cylinders remaining deactivated. Conditions for firing the next cylinder group are monitored.

At T6, the third cylinder is activated and injector 3 is selectively activated and fuel is injected into the third cylinder due to cylinder firing conditions being met. The DFSO continues and the first and second cylinders remain deactivated. After T6 and prior to T7, the third cylinder is fired two times and two fuel pulse widths are produced, each fuel pulse width corresponding to a single combustion event within the third cylinder. The exhaust gas oxygen concentration is converted into measured voltage values corresponding to combustion events in the third cylinder. The measured voltage values (810) of the third cylinder are less than the expected voltage value (812). Therefore, the third cylinder has an air-fuel ratio imbalance, more specifically, a lean air-fuel ratio error or variance. The air-fuel error or voltage error for the third cylinder is learned and may be applied to future third cylinder operations during subsequent engine operations.

For example, in response to a lean air-fuel variation in a cylinder (wherein the actual air-fuel ratio is leaner than the expected air-fuel ratio), the controller may learn an air-fuel error and during subsequent operation, the fueling of the cylinder may be enriched as a function of the air-fuel error.

At T7, the third cylinder is deactivated and thus all the cylinders are deactivated. The open-loop air-fuel ratio control is deactivated and DFSO may continue until DFSO conditions are no longer met. After T7 and prior to T8, DFSO continues and all cylinders remain deactivated. The voltage measured by the HEGO sensor is equal to the minimum voltage.

At T8, the DFSO conditions are no longer met (e.g., tip-in occurs) and the DFSO is exited. Exiting the DFSO includes injecting fuel into all the cylinders of the engine. Therefore, the first cylinder receives fuel from the injector 1 and the second cylinder receives fuel from the injector 2 without any adjustments learned during the open-loop air-fuel ratio control. The fuel injector of the third cylinder may receive fuel injection adjustments based on the learned air-fuel ratio variation to increase or decrease fuel supplied to the third cylinder. The adjustment(s) may include injecting an increased amount of fuel compared to fuel injections during similar conditions prior to the DFSO because the learned air-fuel ratio variation is based on a lean air-fuel ratio variation. By injecting an increased amount of fuel, the third cylinder air-fuel ratio may be substantially equal to a stoichiometric air-fuel ratio (e.g., voltage equal to 0.1). After T8, nominal engine operation continues. DFSO remains deactivated. The first, second, and third cylinders are fired and the HEGO sensor measures a voltage value substantially equal to stoichiometric.

FIG. 9 depicts an operating sequence 900 illustrating example results for an engine cylinder bank comprising three cylinders (e.g., V6 engine with two cylinder banks, each bank comprising three cylinders). Line 902 represents if DFSO is occurring or not, line 904 represents operating state (active or deactivated) of an injector of a first cylinder, line 906 represents operating state (active or deactivated) of an injector of a second cylinder, and line 908 represents operating state (active or deactivated) of an injector of a third cylinder. For lines 904, 906, and 908, a value of "1" represents a fuel injector injecting fuel (e.g., cylinder firing) and a value of "0" represents no fuel being injected (e.g., cylinder deactivated). Solid line 910 represents a heated exhaust gas sensor (HEGO) response in terms of voltage, dotted line 912 represents an expected HEGO response, and lines 914 represent a stoichiometric voltage value (e.g., 0.1). Higher voltage values represent leaner air-fuel ratios while lower voltage values represent richer air-fuel ratios. Solid line 916 represents an upstream exhaust gas sensor (UEGO) response in terms of lambda, dotted line 918 represents an expected UEGO lambda response. Solid line 920 represents a stoichiometric lambda value (e.g., 1). The horizontal axes of each plot represent time and time increases from the left side of the figure to the right side of the figure.

Prior to T1, the first, second, and third cylinders are firing under nominal engine operation (e.g., stoichiometric air-fuel ratio), as illustrated by lines 904, 906, and 908 respectively. As a result, the cylinders produce HEGO voltage values substantially equal to 0.1, as indicated by line 910 and the UEGO lambda values equal to 1, as indicated by line 916. The HEGO voltage and UEGO lambda value may be calculated by a controller (e.g., controller 12 at FIG. 1) from oxygen concentration in the engine exhaust system as measured by exhaust gas sensors (e.g., sensors 126 and 127 at FIG. 1). DFSO is disabled, as indicated by line 902.

At T1, DFSO conditions are met and DFSO is initiated. As a result of the DFSO, fuel is no longer injected into all the cylinders of the engine (that is, fuel and spark to all cylinders is deactivated) and the voltage or air-fuel ratio begins to decrease as air is pumped though engine cylinders without injecting fuel.

After T1 and prior to T2, DFSO continues and the voltage sensed by the HEGO sensor (910) continues to decrease and reaches a minimum voltage. The air-fuel ratio sensed by the UEGO sensor (916) increases and reaches a maximum lean air-fuel ratio.

The injectors may not begin injecting fuel until a threshold time (e.g., 5 seconds) has passed subsequent to initiating the DFSO. Additionally or alternatively, the injectors may begin injecting fuel in response to a predetermined voltage and air-fuel ratio value being detected by the HEGO and UEGO sensor, respectively. Conditions for firing a selected cylinder group are monitored between T1 and T2.

At T2, the first cylinder is activated due to conditions for firing the selected cylinder group being met (e.g., no zero point torque, vehicle speed is less than a threshold vehicle speed, and no downshift) and therefore, injector 1 is selectively reactivated to inject fuel into the first cylinder.

After T2 and prior to T3, the first cylinder is combusting. As shown, the first cylinder combusts two times and produces two separate fuel pulse widths, each fuel pulse width corresponding to a single combustion event. The exhaust oxygen concentration is measured by the HEGO sensor and the controller produces HEGO voltage values corresponding to each combustion event based on deviation from the minimum voltage. The exhaust oxygen concentration is also measured by the UEGO sensor and the controller produces UEGO lambda values corresponding to each combustion event based on deviation from the maximum air-fuel ratio. As will be appreciated by one skilled in the art, other suitable number of firings may be performed. As depicted, the fuel injections to the first cylinder produce different HEGO voltage and UEGO lambda values upon combustion. However, in some examples, the open-loop air-fuel ratio control may inject differing amounts of fuel such that each injection provides a substantially different amount of fuel injected but similar HEGO voltage and UEGO lambda values.

The first cylinder measured voltage or lambda values are compared to an expected voltage or lambda value. The expected voltage or lambda may be based on one or more of a cylinder position in a cylinder bank, a total amount of fuel supplied to the cylinder, engine firing order and fueling timing. The HEGO voltage value (910) is compared to the expected HEGO voltage value (912), while the UEGO lambda value (916) is compared to the expected UEGO lambda value (918). If the measured HEGO voltage and/or UEGO lambda values not equal to the expected HEGO voltage and/or UEGO lambda values then an air-fuel ratio variation causing cylinder to cylinder air-fuel imbalance may be indicated and an injector error may be learned, as described above with respect to FIG. 7. In the depicted example, the first cylinder HEGO voltage and UEGO lambda values are equal to the expected HEGO voltage and UEGO lambda values, thus no air-fuel ratio variation or error value is learned for the first cylinder.

As one example, responsive to a first rich air-fuel variation in a cylinder (wherein the actual air-fuel ratio is richer than the expected air-fuel ratio), the controller may learn a first error and during subsequent operation, the fueling of the cylinder may be enleaned as a function of the first error. Likewise, responsive to a second lean air-fuel variation in a cylinder (wherein the actual air-fuel ratio is leaner than the expected air-fuel ratio), the controller may learn a second error and during subsequent operation, the fueling of the cylinder may be enriched as a function of the second error. For example, if a HEGO air-fuel ratio value for the selected cylinder is 1.8 and the expected HEGO air-fuel ratio value is 1.7, then a lean air-fuel ratio variation may exist with a magnitude of 0.1. Also, if a UEGO air-fuel ratio value for the selected cylinder is 2.2 and the expected UEGO air-fuel ratio value is 1.9, then a lean air-fuel ratio variation may exist with a magnitude of 0.3. Based on the HEGO and UEGO air-fuel variations, an average air-fuel error may be computed as 0.2. The magnitude of the air-fuel error may be applied to future combustion in the cylinder subsequent to the DFSO such that a fuel injection may compensate the air-fuel ratio variation of 0.2 (that is inject an amount of fuel in excess of the determined amount, the extra fuel proportional to the magnitude of 0.2).

At T3, the first cylinder is deactivated and DFSO continues. The HEGO voltage value returns to the minimum voltage and while the UEGO lambda value increases to the maximum lean air-fuel ratio. After T3 and prior to T4, the DFSO continues without firing a selected cylinder group. As a result, the HEGO voltage value remains at the minimum voltage while the UEGO lambda value remains at the maximum air-fuel ratio. The open-loop air-fuel ratio control may select a next cylinder group to fire. The open-loop air-fuel ratio control may allow the voltage to return to the a minimum voltage (in the case of the HEGO sensor) and a maximum lean air-fuel ratio (in the case of the UEGO sensor), prior to firing the next cylinder group in order maintain a consistent background (e.g., the minimum voltage for the HEGO sensor and the maximum lean air-fuel ratio for the UEGO sensor) for each cylinder group. Conditions for firing the next cylinder group are monitored.

In some examples, additionally or alternatively, firing the next cylinder group may occur directly after firing a first cylinder group. In this way, the open-loop air-fuel ratio control may select the next cylinder group at T3 and not allow the HEGO voltage to return to the minimum voltage value or the UEGO lambda value to return to the maximum lambda value, for example.

At T4, the second cylinder is activated and injector 2 is selectively activated and fuel is injected into the second cylinder due to cylinder firing conditions being met. The DFSO continues and the first and third cylinders remain deactivated. After T4 and prior to T5, the second cylinder is fired two times and two fuel pulse widths are produced, each fuel pulse width corresponding to a single combustion event in the second cylinder. The exhaust oxygen concentration is converted into measured HEGO voltage and UEGO lambda values corresponding to HEGO voltage and UEGO lambda values, respectively for the second cylinder. The measured HEGO voltage and UEGO lambda values of the second cylinder are substantially equal to the expected HEGO voltage and UEGO lambda values, respectively. Therefore, no air-fuel ratio imbalance is learned.

At T5, the second cylinder is deactivated and as a result, the HEGO voltage value decreases towards the minimum voltage while the UEGO lambda value increases towards the maximum lean air-fuel ratio. DFSO continues. After T5 and prior to T6, the open-loop air-fuel ratio control selects a next cylinder group and allows the HEGO voltage to return to the minimum voltage and UEGO lambda to return to the maximum air-fuel ratio prior to firing the next cylinder group. DFSO continues with all the cylinders remaining deactivated. Conditions for firing the next cylinder group are monitored.

At T6, the third cylinder is activated and injector 3 is selectively activated and fuel is injected into the third cylinder due to cylinder firing conditions being met. The DFSO continues and the first and second cylinders remains deactivated. After T6 and prior to T7, the third cylinder is fired two times and two fuel pulse widths are produced, each fuel pulse width corresponding to a single combustion event within the third cylinder. The exhaust gas oxygen concentration at both the HEGO and UEGO sensors is converted into measured voltage and lambda values, respectively corresponding to combustion events in the third cylinder. The measured HEGO voltage value (910) of the third cylinder is less than the expected HEGO voltage a value (912). Likewise, the measured UEGO lambda value (916) of the third cylinder is less than the expected UEGO lambda value (918). Therefore, the third cylinder has an air-fuel ratio imbalance, more specifically, a lean air-fuel ratio error or variance. The air-fuel error or lambda error for the third cylinder is learned and may be applied to future third cylinder operations during subsequent engine operations. For example, in response to a lean air-fuel variation in a cylinder (wherein the actual air-fuel ratio is leaner than the expected air-fuel ratio), the controller may learn an air-fuel error and during subsequent operation, the fueling of the cylinder may be enriched as a function of the air-fuel error.

At T7, the third cylinder is deactivated and thus all the cylinders are deactivated. The open-loop air-fuel ratio control is deactivated and DFSO may continue until DFSO conditions are no longer met. After T7 and prior to T8, DFSO continues and all cylinders remain deactivated. The voltage measured at the HEGO sensor is equal to the minimum air-fuel ratio while the lambda measured at the UEGO sensor is equal to the maximum lean air-fuel ratio.

At T8, the DFSO conditions are no longer met (e.g., tip-in occurs) and the DFSO is deactivated. Deactivating the DFSO includes injecting fuel into all the cylinders of the engine. Therefore, the first cylinder receives fuel from the injector 1 and the second cylinder receives fuel from the injector 2 without any adjustments learned during the open-loop air-fuel ratio control. The fuel injector of the third cylinder may receive fuel injection timing adjustments based on the learned air-fuel ratio variation to increase or decrease fuel supplied to the third cylinder. The adjustment(s) may include injecting an increased amount of fuel compared to fuel injections during similar conditions prior to the DFSO because the learned air-fuel ratio variation is based on a lean air-fuel ratio variation. By injecting an increased amount of fuel, the third cylinder air-fuel ratio may be substantially equal to a stoichiometric air-fuel ratio (e.g., UEGO lambda equal to 1). After T8, nominal engine operation continues. DFSO remains deactivated. The first, second, and third cylinders are fired and the HEGO and UEGO sensors measure voltage and air-fuel ratio values substantially equal to stoichiometric (e.g., 0.1 for the HEGO sensor and 1.0 for UEGO sensor).

Referring now to FIG. 10, a method for judging whether or not to supply fuel to reactivate deactivated cylinders for the purpose of determining cylinder imbalance is shown. The method of FIG. 10 may be applied in conjunction with the method if FIGS. 4-7 to provide the sequences shown in FIGS. 8-9. Alternatively, the method of FIG. 10 may be the basis for when samples of exhaust gases may be included for learning cylinder air-fuel imbalance.

At 1002, method 1000 judges whether or not a request to shift transmission gears is present or if a transmission gear shift is in progress. In one example, method 1000 may determine a shift is requested or in progress based on a value of a variable in memory. The variable may change state based on vehicle speed and driver demand torque. If method 1000 judges that a transmission gear shift is requested or in progress, the answer is YES and method 1000 proceeds to 1016. Otherwise, the answer is NO and method 1000 proceeds to 1004. By not injecting fuel to deactivated cylinders during transmission gear shifts, air-fuel ratio variation may be reduced to improve the air-fuel signal to noise ratio.

At 1004, method 1000 judges whether or not a request engine speed is within a desired speed range (e.g., 1000-3500 RPM). In one example, method 1000 may determine engine speed from an engine position or speed sensor. If method 1000 judges that the engine speed is within a desired range, the answer is YES and method 1000 proceeds to 1006. Otherwise, the answer is NO and method 1000 proceeds to 1016. By not injecting fuel to deactivated cylinders when engine speed is out of range, air-fuel ratio variation may be reduced to improve the air-fuel signal to noise ratio.

At 1006, method 1000 judges whether or not a request engine deceleration is within a desired range (e.g., less than 300 RPM/sec.). In one example, method 1000 may determine engine deceleration from the engine position or speed sensor. If method 1000 judges that the engine deceleration is within a desired range, the answer is YES and method 1000 proceeds to 1008. Otherwise, the answer is NO and method 1000 proceeds to 1016. By not injecting fuel to deactivated cylinders when engine deceleration rate is out of range, air-fuel ratio variation may be reduced to improve the air-fuel signal to noise ratio.

At 1008, method 1000 judges whether or not engine load is within a desired range (e.g., between 0.1 and 0.6). In one example, method 1000 may determine engine load from an intake manifold pressure sensor or a mass air flow sensor. If method judges that the engine load is within a desired range, the answer is YES and method 1000 proceeds to 1009. Otherwise, the answer is NO and method 1000 proceeds to 1016. By not injecting fuel to deactivated cylinders when engine load is out of range, air-fuel ratio variation may be reduced to improve the air-fuel signal to noise ratio.

At 1009, method 1000 judges whether or not the torque converter clutch is open and the torque converter is unlocked. If the torque converter is unlocked, the torque converter turbine and impeller may rotate at different speeds. The torque converter impeller and turbine speeds may be indicative of whether or not the driveline is passing through or being at a zero torque point. However, if the torque converter clutch is locked, the indication of the zero torque point may be less clear. The torque converter clutch state may be sensed or a bit in memory may indicate whether or not the torque converter clutch is open. If the torque converter clutch is unlocked, the answer is YES and method 1000 proceeds to 1010. Otherwise, the answer is NO and method 1000 proceeds to 1014. Thus, in some examples, the torque converter clutch may be commanded open to unlock the torque converter when the determination of cylinder air-fuel ratio imbalance is desired.

At 1010, method 1000 determines an absolute value of a difference between torque converter impeller speed and torque converter turbine speed. The speed difference may be indicative of the engine transitioning through a zero torque point where engine torque is equivalent to driveline torque. During vehicle deceleration, engine torque may be reduced and vehicle inertia may transfer a negative torque from vehicle wheels into the vehicle driveline. Consequently, a space between vehicle gears referred to gear lash may increase to where the gears briefly fail to positively engage, and then the gears engage on an opposite side of the gears. The condition where there is a gap between gear teeth (e.g., gear teeth are not positively engaged) is the zero torque point. The increase in gear lash and subsequent reengagement of gear teeth may cause driveline torque disturbances which may induce cylinder air amount changes that may result in air-fuel ratio variation. Therefore, it may be desirable to not inject fuel to select cylinders at the zero torque point during DFSO to reduce the possibility of skewing air-fuel ratio imbalance determination. Torque converter impeller speed being within a threshold speed of torque converter turbine speed (e.g., within ±25 RPM) may be indicative of being at or passing through the zero torque point where space between gears increases or lash develops. Therefore, fuel injection may be ceased until the driveline transitions through the zero torque point to avoid the possibility of inducing air-fuel ratio imbalance determination errors. Alternatively, fuel injection may not be started until after the driveline passes through the zero torque point and gear teeth reengage during DFSO. Method 1000 proceeds to 1012 after the absolute value of the difference in turbine speed and impeller speed is determined.

At 1012, method 1000 judges if the absolute value of the difference in torque converter impeller speed and torque converter turbine speed is greater than a threshold (e.g., 50 RPM). If so, the answer is YES and method 1000 proceeds to 1014. Otherwise, the answer is NO and method 1000 proceeds to 1016.

At 1014, method 1000 indicates that conditions for activating fuel injection to selected engine cylinders during DFSO to determine cylinder air-fuel imbalance are met. Consequently, one or more deactivated engine cylinders may be reactivated by injecting fuel into the select cylinders and combusting the fuel. Method 1000 indicates to the method of FIGS. 4-7 that conditions for injecting fuel to select deactivated cylinders during DFSO are present and exits.

Alternatively at 1014, method 1000 indicates that conditions for applying or using exhaust air-fuel or lambda samples to determine cylinder air-fuel imbalance are met. Therefore, exhaust samples may be included to determine an average exhaust lambda or air-fuel value for cylinders reactivated during DFSO.

At 1016, method 1000 indicates that conditions for activating fuel injection to selected engine cylinders during DFSO to determine cylinder air-fuel imbalance are not met. Consequently, one or more deactivated engine cylinders continue to be deactivated until conditions for injecting fuel to deactivated cylinders are present. Additionally, it should be noted that fueling of one or more cylinders may be stopped and then restarted in response to conditions for injecting fuel changing from being present to not being present then later being present. In some examples, analysis for cylinder imbalance starts over for cylinders receiving fuel so that the cylinder's air-fuel ratio is not averaged based on air-fuel ratio before and after conditions where fuel is not injected. Method 1000 indicates to the method of FIGS. 4-7 that conditions for injecting fuel to select deactivated cylinders during DFSO are not present and exits.

Alternatively at 1016, method 1000 indicates that conditions for applying or using exhaust air-fuel or lambda samples to determine cylinder air-fuel imbalance are not met. Therefore, exhaust samples may not be included to determine an average exhaust lambda or air-fuel value for cylinders reactivated during DFSO. In this way, the open-loop air-fuel ratio control may be more consistent (e.g., replicated) from a first selected cylinder group to a second selected cylinder group. It will be appreciated by one skilled in the art that other suitable conditions and combinations thereof may be applied to begin fuel injection to cylinders deactivated during the DFSO event. For example, fuel injection may begin a predetermined amount of time after an exhaust air-fuel ratio is leaner than a threshold air-fuel ratio.

In one example, a method comprises: during a deceleration fuel shut-off (DFSO) event, sequentially firing cylinders of a cylinder group, each fueled with a fuel pulse width selected to provide a fixed air-fuel deviation; and indicating an air-fuel ratio variation for each cylinder based on an error between an actual air-fuel deviation from a maximum lean air-fuel ratio during the DFSO relative to the fixed air-fuel deviation. In the preceding example, additionally or optionally, the fixed air-fuel deviation is determined as a fixed air-fuel deviation at an exhaust gas sensor coupled downstream of an exhaust catalyst, wherein the actual air-fuel deviation is estimated by the exhaust gas sensor coupled downstream of the exhaust catalyst, and wherein the exhaust gas sensor is a heated exhaust gas sensor. In any or all of the preceding examples, additionally or optionally, the fixed air-fuel deviation is determined based on a sensitivity of the exhaust gas sensor and further determined based on a minimum pulse width of an injector of the cylinder group. In any or all of the preceding examples, additionally or optionally, the fixed air-fuel deviation is further determined based on one or more of engine speed, engine temperature, and engine load. Any or all of the preceding examples may additionally or optionally further comprise, during subsequent engine operation with all engine cylinders firing, adjusting cylinder fueling based on the indicated air-fuel ratio variation.

In the preceding example, additionally or optionally, adjusting cylinder fueling includes adjusting a fuel injector pulse width for the cylinder based on the error. In any or all of the preceding examples, additionally or optionally, the cylinder group is selected based on one or more of a firing order and a cylinder position within the firing order. In any or all of the preceding examples, additionally or optionally, fueling of the cylinder group with the fuel pulse width occurs after the maximum lean air-fuel ratio is measured during the DFSO. In any or all of the preceding examples, additionally or optionally, the cylinder group is fueled and operated to perform a combustion cycle a plurality of times during the DFSO producing a plurality of air-fuel ratio responses, and wherein the indicated air-fuel ratio variation is based on an average of the plurality of air-fuel ratio responses.

In yet another example, a method comprises: after disabling all cylinders leading to a common exhaust of an engine, sequentially fueling each of the disabled cylinders; during a first condition, learning an air-fuel ratio variation for each of the disabled cylinders based on a first error between an actual air-fuel deviation from a maximum lean air-fuel ratio relative to a fixed air-fuel deviation at a first exhaust gas sensor coupled downstream of an exhaust catalyst in the common exhaust; and during a second condition, learning the air-fuel ratio variation based on a second error between the actual air-fuel deviation from a maximum lean air-fuel ratio relative to the fixed air-fuel deviation estimated at a second exhaust gas sensor coupled upstream of the exhaust catalyst in the common exhaust. The preceding example may additionally or optionally further comprise, during a third condition learning the air-fuel ratio variation based on the first error relative to the second error. In any or all of the preceding examples, additionally or optionally, learning the air-fuel ratio variation is based on the first error relative to the second error and learning the air-fuel ratio variation based on an average of the first and the second error. In any or all of the preceding examples, additionally or optionally, the first condition includes the second exhaust sensor being degraded or the second exhaust sensor being selectively more sensitive to cylinders within a threshold distance of the second exhaust gas sensor and less sensitive to cylinders outside the threshold distance, wherein the second condition includes the second exhaust sensor not being degraded or the second exhaust sensor not being selectively more sensitive to the cylinders within the threshold distance of the second exhaust gas sensor, and wherein the third condition includes the first exhaust sensor being degraded. Any or all of the preceding examples may additionally or optionally further comprise, reactivating the cylinders after the learning, and adjusting cylinder fueling during the reactivating based on the learning. In any or all of the preceding examples, additionally or optionally, during the first condition, the fixed air-fuel deviation is higher than a threshold deviation at the first exhaust sensor, and during the second condition, the fixed air-fuel deviation is lower than the threshold deviation at the first exhaust sensor. In any or all of the preceding examples, additionally or optionally, the fixed air-fuel deviation is based on engine load and speed. In any or all of the preceding examples, additionally or optionally, the cylinders leading to a common exhaust are coupled on a common engine bank, and wherein the fixed air-fuel deviation is based on a position of a cylinder being sequentially fueled on the common engine bank. In any or all of the preceding examples, additionally or optionally, the fixed air-fuel deviation is further based on a firing order of the cylinder being sequentially fueled.

In another example approach, a method comprises: during a deceleration fuel shut-off (DFSO) event, sequentially firing each cylinder of a cylinder group, each cylinder fueled with a fuel pulse width selected to provide a first fixed air-fuel deviation at a first exhaust gas sensor coupled downstream of an exhaust catalyst and a second, different fixed air-fuel deviation at a second exhaust gas sensor coupled upstream of the exhaust catalyst; and indicating an air-fuel ratio variation for each cylinder based on a first error between an actual air-fuel deviation at the first sensor and the first fixed deviation, and further based on a second error between an actual air-fuel deviation at the second sensor and the second fixed deviation. In the preceding example, each of the first fixed deviation, the second fixed deviation, and the actual deviation are measured relative to a maximum lean air-fuel ratio following the deceleration fuel shut-off.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

operating in a first condition and during operating in the first condition:

after disabling fueling to all cylinders leading to a common exhaust of an engine, sequentially fueling each of the disabled cylinders via fueling only one cylinder of all cylinders at a time, for multiple combustion events, while maintaining remaining cylinders of all cylinders disabled; and during the sequential fueling of each of the disabled cylinders:

for each of the cylinders, following fueling the only one cylinder while maintaining remaining cylinders disabled, learning an air-fuel ratio variation for the one cylinder based on a first error between an actual air-fuel deviation from a maximum lean air-fuel ratio relative to a fixed air-fuel deviation estimated at a first exhaust gas sensor coupled downstream of an exhaust catalyst in the common exhaust for each of the multiple combustion events, and following learning the air-fuel ratio variation for the one cylinder for each of the multiple combustion events, disabling fueling to all cylinders for a period of time before sequentially firing a next cylinder of all cylinders; and operating in a second condition and during operating in the second condition:

after disabling fueling to all cylinders leading to the common exhaust of the engine, sequentially fueling each of the disabled cylinders via fueling only one cylinder of all cylinders at a time, for multiple combustion events, while maintaining the remaining cylinders of all cylinders disabled; and during the sequential fueling of each of the disabled cylinders: for each of the cylinders, following fueling the only one cylinder while maintaining the remaining cylinders disabled, learning the air-fuel ratio variation based on a second error between the actual air-fuel deviation from the maximum lean air-fuel ratio relative to the fixed air-fuel deviation estimated at a second exhaust gas sensor coupled upstream of the exhaust catalyst in the common exhaust for each of the multiple combustion events, and following learning the air-fuel ratio variation for the one cylinder for each of the multiple combustion events, disabling fueling to all cylinders for a period of time before sequentially firing the next cylinder of all cylinders.

2. The method of claim 1, wherein during the first condition the air-fuel ratio variation is learned at the first exhaust gas sensor only and not the second exhaust gas sensor, wherein during the second condition the air-fuel ratio variation is learned at the second exhaust gas sensor only and not the first exhaust gas sensor, and further comprising, operating in a third condition and during operating in the third condition, learning the air-fuel ratio variation based on the first error relative to the second error using each of the first exhaust gas sensor and the second exhaust gas sensor, and wherein learning the air-fuel ratio variation based on the first error for each of the multiple combustion events includes learning the air-fuel variation based on an average of the first error for each of the multiple combustion events and wherein learning the air-fuel ratio variation based on the second error for each of the multiple combustion events includes learning the air-fuel variation based on an average of the second error for each of the multiple combustion events.

3. The method of claim 2, wherein learning the air-fuel ratio variation based on the first error relative to the second error includes learning based on an average of the first and the second error.

4. The method of claim 2, wherein the first condition includes the second exhaust gas sensor being degraded, wherein the third condition includes each of the first exhaust gas sensor and the second exhaust gas sensor not being degraded, and wherein the second condition includes the first exhaust gas sensor being degraded.

5. The method of claim 1, further comprising reactivating all the cylinders, according to a firing order of the engine, after the learning, and adjusting cylinder fueling during the reactivating based on the learned air-fuel ratio variation.

6. The method of claim 1, wherein during the first condition, the fixed air-fuel deviation is higher than a threshold deviation at the first exhaust gas sensor, and during the second condition, the fixed air-fuel deviation is lower than the threshold deviation at the first exhaust gas sensor.

7. The method of claim 1, wherein the fixed air-fuel deviation is based on engine load and speed, wherein the disabling fueling to all cylinders and sequentially fueling each of the disabled cylinders occurs responsive to conditions for a deceleration fuel shut-off event being met, and wherein the multiple combustion events include injecting fuel as multiple separate fuel pulse widths, each corresponding to a single combustion event of the multiple combustion events.

8. The method of claim 1, wherein the cylinders leading to the common exhaust are coupled on a common engine bank, and wherein the fixed air-fuel deviation, for each cylinder, is based on a position of the cylinder being sequentially fueled on the common engine bank.

9. The method of claim 8, wherein the fixed air-fuel deviation for each cylinder is further based on a firing order of the cylinder being sequentially fueled.

* * * * *